US005611253A

United States Patent [19]

Saito et al.

[11] Patent Number: 5,611,253

[45] Date of Patent: Mar. 18, 1997

[54] CUTTING DEVICE

[75] Inventors: Daisuke Saito, Tokyo-to; Hideaki Matsuda, Miyagi-ken, both of Japan

[73] Assignee: Tohoku Ricoh Co., Ltd., Miyagi-ken, Japan

[21] Appl. No.: 301,962

[22] Filed: Sep. 7, 1994

[30] Foreign Application Priority Data

Sep. 7, 1993 [JP] Japan ..... 5-222418
Oct. 7, 1993 [JP] Japan ..... 5-251417

[51] Int. Cl.[6] ..... B26D 5/00

[52] U.S. Cl. ..... 83/383; 83/614; 83/676

[58] Field of Search ..... 83/383, 614, 380, 83/385, 386, 378, 455, 676

[56] References Cited

U.S. PATENT DOCUMENTS 1,453,200 4/1923 Stacho ..... 83/383
1,541,155 6/1925 Kroesen ..... 83/383
1,732,148 10/1929 Barrett ..... 83/383
4,516,451 5/1985 Takeshita et al. ..... 83/614
5,086,682 2/1992 Strub et al. ..... 83/614
5,168,786 12/1992 Huggins et al. ..... 83/614
5,312,058 5/1994 Brandt et al. ..... 83/614

*Primary Examiner*—Kenneth E. Peterson
*Attorney, Agent, or Firm*—Armstrong, Westerman, Hattori, McLeland & Naughton

[57] ABSTRACT

In a cutting device having a moving (disc) cutter and a fixed cutter which extends in a cutting direction, wherein the moving cutter moves along the fixed cutter, thereby cutting a medium which is interposed therebetween, a presser member which is movable together with a medium pressing interlocking plate is lowered to press on the medium to fix the same at a portion close to a cutting position since a bearing attached to the moving cutter engages with the medium pressing interlocking plate to press down the same as the moving cutter moves. Since the moving cutter cuts the medium at this state, the cut edge of the medium can be excellent in linearity even if it has low rigidity in the outward-surface direction at right angles to the surface thereof. While the moving cutter does not cut the medium, the presser member is retracted to a standby position.

4 Claims, 29 Drawing Sheets

CUTTING DEVICE

FIELD OF THE INVENTION

The present invention relates to a cutting device which is provided in a printer, a ticket vending machine, etc. for cutting off a piece of a predetermined length from a long medium to be cut (referred to simply as a medium hereinafter in this specification) by a movable cutter and a fixed cutter, the medium being, e.g., a print medium such as a paper belt, a cloth belt, a label belt or the like on which printing is made continuously and successively.

DESCRIPTION OF PRIOR ART

There is a conventional cutting device for successively cut off a piece of a predetermined length from a continuous belt of medium by a disc cutter that is a moving cutter and a fixed cutter such as that shown in FIG. 34 as a simplified view.

After a medium 2 has been fed on a guide plate I in the direction of an arrow A to be stopped at a predetermined cutting position, the cutting device cuts a medium 2 with a disc cutter 3 which cuts in the medium 2 from a side edge 2*a* in the direction of an arrow B which is perpendicular to the feeding direction of the medium 2 and a fixed cutter 4 which is fixed to a side of the guide plate 1 along the moving direction of the disc cutter 3.

Some cutting devices cut off a piece of a predetermined length from a belt of medium inserted between a rotating cutter 6 which is rotated in the direction of an arrow J by a motor 5 and a fixed cutter 8 which is swingably supported by a shaft 7 and is pressed on the rotating cutter 6 by a spring 9 as illustrated in FIGS. 35A and 35B.

In case of the cutting device illustrated in FIG. 34, however, when the medium 2 to be cut is thin paper, cloth label, etc., the medium 2 is liable to be twisted while being cut since friction generated between the disc cutter 3 and the medium 2 deforms the medium 2 in the direction of Z (deformation in the outward-surface direction).

As a result, it often caused the poor linearity of cut surface of the medium 2 so that nearly cut surface could hardly be obtained.

A guillotine-type cutter device as illustrated in FIGS. 35A and 35B can easily obtain the linearity of cut surface compared with the disc-type cutting device, but causes resistance against cutters larger than that in case of the disc-type cutting device at the time of cutting the medium 2 so that repeatedly cutting the medium 2 at sufficient speed requires a large power source corresponding thereto, resulting in a problem of increasing power consumption as well as increasing the size of the cutting device.

Accordingly, the applicant discloses a cutting device employing presser rollers in former Japanese Patent Laid-Open Publication No. 5-213514 (stacker) as a trial to improve the linearity of cut surface of the medium in a cutting device using the disc and fixed cutters.

A cutting device provided in a printing device equipped with the stacker comprises a carriage 15 which rotatably supports a disc cutter 3 and reciprocates in the direction of an arrow M, presser arms 12 supported by the carriage 15 to be swingable about a fulcrum 11 and presser rollers 13 and 13 rotatably provided at the lower end portions of the opened presser arms 12 respectively.

The presser rollers 13 and 13 press on the medium 2 to prevent the same from getting out of position when the disc cutter 3 moves fight or left in the figure to cut the medium

2 cooperating with the fixed cutter 4 so as to prevent the deformation of the medium 2 even if the cutting resistance is generated.

Even this cutting device, however, is not enough to obtain the linearity of the cut surface preventing the deformation of the medium when the same is cut since the direction of force which generates the outward deformation of the cut medium in the direction perpendicular to the surface thereof as indicated by Z in FIG. 34 conforms to that of friction generated by the rotation of the presser rollers 13 and 13.

Moreover in case of a printing device such as a thermal printer etc. which is generally equipped with such a cutting device, the medium is liable to be charged with static electricity in the process of bringing an ink ribbon into close contact with the medium to print characters thereon by heating using a thermal head, the process of peeling off a ribbon using a ribbon peeling plate, etc., in case a cloth label or the like is used for the print medium.

Furthermore, such a cloth label or the like is liable to be deformed since it has low rigidity in the direction perpendicular to the surface of the medium, the direction being indicated by an arrow Z in FIG. 34, it is liable to cause trouble in feeding when it comes off the upper and lower guide plates (the upper guide plate is omitted to be shown in FIG. 34) which apply force to keep it in position.

Whereas a printing device such as a thermal printer etc., which successively draws out a print medium, e.g., a roll of long paper etc. and performs necessary printing thereon by a thermal head with a thermal transfer ribbon in close contact with the print medium, is also equipped with a cutting device for cutting a piece of a predetermined length from every time printing has been performed thereon.

The cutting device, for example, comprises a fixed cutter I provided widthwise at right angles to the feeding direction (direction of an arrow A) of the medium 2 and a disc cutter 3 that is a moving cutter reciprocating in the direction of an arrow Q and is pressed on the fixed cutter I so as to successively cut off a piece of a predetermined length from the medium 2 such as a long paper, which has been fed onto the fixed cutter 1, by moving the disc cutter 3 along the edge of the fixed cutter 1.

In case of the cutting device having a disc cutter which is moved along the edge of the fixed cutter while being pressed thereon, however, when the piece of a predetermined length is successively stacked on one another just after it is cut off from the medium such as a long paper, the cut medium is liable to be aslant relative to the fixed cutter 1 at the cut edge 2*b* thereof as the cut medium 2' illustrated in FIG. 37.

Accordingly, many such cutting devices which cut a medium such as long paper by moving a disc cutter feed the cut medium downstream in the feeding direction instead of stacking the same just after cutting and stack the same on a tray at a position apart from the cutting portion or cuts down the same without piling the same to be collected afterwards.

Moreover, in case the medium is stacked on a tray just after the same is cut off, the uppermost medium which has been stacked on the tray is liable to be pushed off by the tip end of next medium which is successively fed, so that the stack is liable to be disturbed.

SUMMARY OF THE INVENTION

The present invention has been made to solve the above problem in cutting devices. It is an object of the invention to obtain an excellent linearity of cut surface even if a cut medium is low in rigidity in a direction at right angles to the surface thereof (the outward direction of the surface).

It is another object of the invention to prevent the generation of trouble such as defective feeding caused by static electricity generated in the cut medium in a stage of feeding by instantly removing the static electricity.

It is still another object of the invention to form a neat and undisturbed stack of cut mediums in case of cutting a medium such as long paper by moving a moving cutter along an edge of a fixed cutter even if the cut medium is successively stacked just after cutting.

In order to attain the above objects, the cutting device according to the invention comprises a presser member for fixing the medium to be cut by pressing on the same at a position close to a cutting position by the moving cutter and the fixed cutter set forth above and a presser member moving means for retracting the presser member to a standby position when the medium is fed to the cutting position, while for moving the presser member to a position to which the medium is pressed on to be fixed when the same is fed to the cutting position.

In the thus constructed cutting device, the presser member moving means moves the presser member to press on and fix the medium at a position close to the cutting position, so that even if the cut medium is low in rigidity in a direction perpendicular to the surface thereof (the outward direction of the surface), the excellent linearity of cut surface can be obtained.

Since the presser member moving means retracts the presser member to the standby position when the medium is fed to the cutting position, it does not interfere with the feeding of the medium.

When the presser member moving means is equipped with an engaging member, a presser member interlocking member and a biasing member, the movement of the moving cutter for cutting the medium is followed by the movement of the engaging member, which engages the presser member interlocking member to move the same to a position where the presser member presses on and fix the medium.

Accordingly, it is possible to interlock the movement of the presser member with that of the moving cutter without providing a control system for moving the presser member following that of the moving cutter.

Moreover, if the engaging member is movable to a position where it engages with the presser member interlocking member and a position where it does not engage therewith, it is possible to move the engaging member to the non-engaging position set forth above in case of cutting a medium which need not be pressed on to be fixed in cutting due to its high rigidity.

If the presser member interlocking member is provided with an inclination restricting member for restricting the inclination of the presser member relative to the above medium pressed on by the presser member which has been moved to a fixing position, the presser member can press on the medium at a position close to the cutting position almost uniformly all over a cutting line for more securely fix the medium since the inclination restricting member restricts the inclination of the presser member relative to the pressed-on medium when the presser member interlocking member being interlocked with the cutting operation of the moving cutter moves to the position where the presser member presses on the medium to fix the same.

Furthermore, if the presser member moving means is provided with a moving means for moving the presser member to a position where the presser member presses on the medium to fix the same at a position close to the cutting position and to the standby position and a control means for moving the presser member from the standby position to the fixing position, it is possible to arbitrarily move the presser member from the standby position to the fixing position by selectively driving a driving source of the moving means depending on the kind of the medium to be cut.

Still furthermore, when a cutting device is provided with a separating guide member, even if a medium charged with electricity is fed to a position where the presser member is disposed, the separating guide member advances between the presser member and the medium to separate the former from the latter and further guides the medium in the feeding direction when the latter is fed to the cutting position.

Accordingly, even if the fed medium is charged with electricity, it is possible to prevent the same from sticking to the presser member caused by static electricity.

Still Furthermore, if the presser member is equipped with a pressure adjusting mechanism for adjusting the pressure with which the presser member presses on the medium to fix the same, it is possible to prevent the medium from being stained when an excessive pressure is applied thereto since the mechanism can adjust pressure depending on the kind of medium.

Still furthermore, if at least the portion of the presser member which is in contact with the medium is made of conductive elastic material such as conductive felt, urethane foam, rubber, sponge or the like each having electrical conductivity, it is possible to prevent the medium from being electrostatically attracted by a feeding surface such as the guide plate etc. and consequently feed the same smoothly since even if the medium is charged with electricity, it can be discharged via the presser member when the medium is brought into contact with the presser member.

Still furthermore, the cutting device may be provided with a medium displacement restricting member which is disposed downstream the cutting position of the moving and fixed cutters with regard to the feeding direction of the medium and which is movable to a position where the medium displacement restricting member presses the medium on to prevent the same from slipping in the direction along the surface thereof and to a standby position where the medium displacement restricting member stays away from the surface of the medium and a stack tray on which the medium cut by the moving and fixed cutters and then pressed on by the medium displacement restricting member is successively stacked and which is held by a fixed portion of the cutting device in such a way as to go away from the medium displacement restricting member in accordance with the number of stacked mediums.

With this arrangement, if the medium displacement restricting member moves to the position where it prevents the medium from getting out of position as the moving cutter moves to cut the medium, the medium is cut as it is pressed on by the medium displacement restricting member, so that the stack is not disturbed even if the medium is stacked on the stack tray just after it is cut.

Moreover, since the stack tray goes down in accordance with the number of cut mediums successively stacked thereon, the upper surface of a lastly cut medium is kept at a given height relative to the feeding surface of the medium.

If the medium displacement restricting member is made of a flexible belt, it is possible to adopt a disc cutter for the moving cutter and pass the belt along the outer periphery thereof where the belt does not influence the disc cutter in cutting the medium.

Accordingly, as the disc cutter moves in the cutting direction while rotating, it successively pressed down the portion of the belt which is brought into contact with the outer periphery thereof to press on the surface of the medium, so that it is possible to cut the medium with certainty and at the same time to keep the cut medium in position after it is cut.

Moreover, in the cutting device provided with the belt and the moving cutter (disc cutter) which travels in the cutting direction while rotating, the belt may be a toothed belt and grooves which engages with the toothed belt may be formed on the moving cutter or a member which rotates integrally with the moving cutter, or a helical projection having a given pitch may be formed on the outer surface of the belt and grooves may be formed on the portion of the moving cutter or a member which rotates integrally with the moving cutter which is in contact with the belt.

Furthermore, if the medium displacement restricting member is a medium presser member disposed in parallel with the fixed cutter, the medium presser member can press on a wide range of the medium along the cutting direction at the time of cutting the medium, so that the surface of the medium can be more efficiently restrained from getting out of position in the direction along the surface thereof. As a result, it is possible to cut the medium with more certainty and stack the cut medium on the stack tray without disturbing the stack.

Still furthermore, if the cutting device is provided with a cutting operation interlocking member, since it interlocks with a member, which travels in the cutting direction together with the moving cutter at the time of cutting when the moving cutter travels, the member moves the medium presser member to the position to press on the medium so that it is possible to cut the medium in this state.

Still furthermore, if the cutting device is provided with an actuator which arbitrarily moves the medium presser member between the standby position where it is retracted from the surface of the medium to the position where it presses on the medium and a means which selectively actuates the actuator, it is possible to selectively allow the medium presser member to press on the medium depending on the kind or use of the medium by selectively actuating the actuator depending on the kind of the medium.

If the stack tray is held by the fixed portion of the cutting device to be movable in a direction away from the medium displacement restricting member by way of a mechanism making use of friction, it is possible to simplify the control and mechanism of the device since the stack tray need not be lowered by the thickness of the medium by way of an elevator unit using a motor etc. every time a cut medium is stacked on the stack tray.

Moreover, the cut mediums stacked on the stack tray is prevented from being pushed out by next cut medium fed onto the stack tray by providing a medium stack rising restricting member for restricting the height of the surface of the uppermost cut medium on the stack tray slightly lower than that of a feeding path at the cutting position set forth above when the medium displacement restricting member is retracted from the surface of the uppermost medium.

The above and other objects, features and advantages of the invention will be apparent from the following detailed description which is to be read in conjunction with the accompanying drawings.

DETAILED DESCRIPTION OF THE PREFERRED EMBODIMENT

First Embodiment (FIGS. 1 to 4 )

The embodiments of the present invention will be described in concrete hereinafter with reference to drawings.

The construction of a cutting device according to a first embodiment of the invention will be described with reference to FIGS. 1A, 1B, 2A and 2B and that of a printing device on which the cutting device is mounted will be described with reference to FIG. 3 hereinafter.

Figure 3:
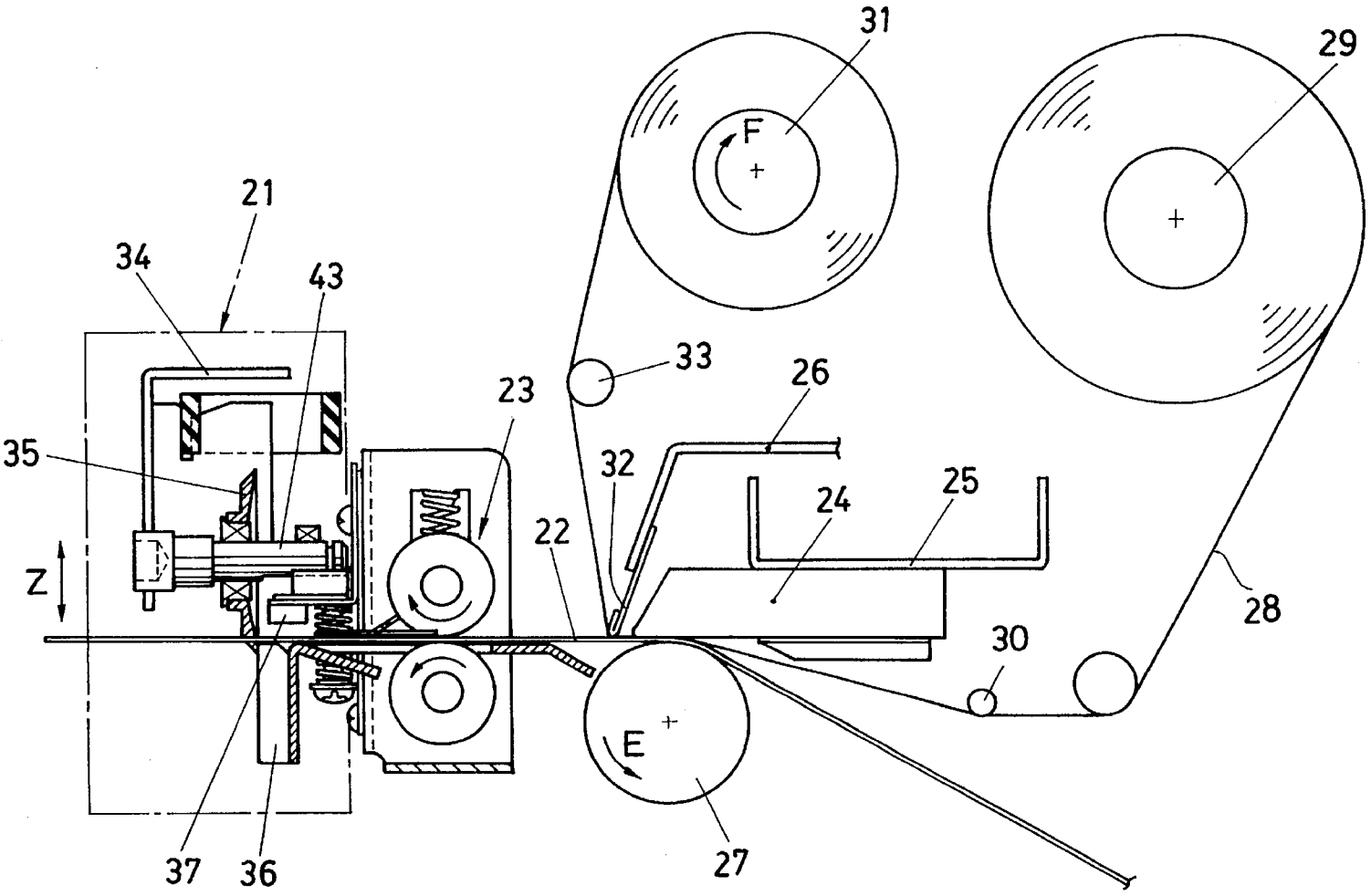
FIG. 3 is a view showing a whole construction of a printing device on which the cutting device is mounted.

The printing device illustrated in FIG. 3 comprises a pair of a disc cutter 35 that is a moving cutter and a fixed cutter 36 which extends in the cutting direction represented by a face-to-back direction in the figure.

The printing device is provided with a cutting device 21. The cutting device 21 moves a carriage 34 along a guide, not shown, along the edge of which extends in the cutting direction at the upper end of the left surface of the fixed cutter 36 in FIG. 3 while pressing the disc cutter 35 on the fixed cutter 36 by way of a spring etc. so as to cut a medium 22 such as long paper etc. which is continuous in a shape of belt lying between the disc cutter 35 and fixed cutter 36.

The cutting device 21 is provided with a presser member 37 for pressing on the medium 22 to fix the same at a position close to the cutting position of the disc cutter 35 and fixed cutter 36 (a position illustrated in FIG. 2B) in order to cut the medium 22 straight and with certainty even if the medium 22 from which a piece of a predetermined length is cut off after characters are printed thereon is a medium such as thin paper, cloth label or the like, which is comparatively low in rigidity the direction perpendicular to the surface of the medium, i.e., the outward direction of the surface indicated by an arrow Z.

The cutting device 21 is also provided with a presser member moving means for moving the presser member 37 to a position where it presses on the medium 22 at a position close to the cutting position set forth above interlocking with the movement of the disc cutter 35 of the cutting device 21 and a standby position (a position illustrated in FIG. 2A) where the presser member 37 allows the medium 22 to be fed to the cutting position of the disc cutter 35 and fixed cutter 36.

The presser member moving means will be described in detail later.

A feed roller pair 23 which are pressed on each other in rotation is provided upstream the feeding path of the cutting device 21 on the right side of FIG. 3 and a thermal head 24 for performing printing on the medium 22 is provided further at the upstream side of the feed roller pair 23.

The thermal head 24 is a line-type thermal head, which is fixed to the lower surface of a thermal head plate 25 and is pressed on a platen roller 27 by way of a presser member, not shown, mounted on a head frame 26.

The medium 22 on which printing is performed and a heat transfer ribbon 28 placed over the medium 22 are inserted between the thermal head 24 and the platen roller 27 and the platen roller 27 is rotated in the direction of an arrow E while selectively heating the heat transfer ribbon 28 by the thermal head 24 to print a predetermined characters on the medium 22.

Following the feeding of the medium 22 by the platen roller 27, the heat transfer ribbon 28 is fed from the side of a ribbon supply spool 29 to be brought into close contact with the upper surface of the medium 22 after it passes a guide shaft 30 when printing is performed by the thermal head 24 thereon.

Then the heat transfer ribbon 28 is peeled off from the medium 22 by the ribbon peel-off plate 32 to be rolled round a take-up spool 31 via the winding guide shaft 33, the heat transfer ribbon 28 being peeled off due to tension applied to the portion thereof which was used for printing by the take-up spool 31 which rotates in the direction of an arrow F and due to tension applied to the medium 22 by the feeding force of the feed roller pair 23 which rotate in the direction of the arrow in FIG. 3.

On the other hand, the printed medium 22 is fed to the cutting device 21 by the feed roller pair 23.

Then the carriage 34 which rotatably holds the disc cutter 35 of the cutting device 21 by way of the shaft 43 alternately moves face-to-back and back-to-face in the figure at every cutting timing corresponding to the feeding length of a piece to be cut off from the medium 22 based on a data of rotating amount of the platen roller 27, a signal issued by a transmission-type or reflector-type sensor, not shown, mounted on the feeding path upon detection of the medium 22 or based on the feeding amount of the medium 22 so as to cut the medium 22 by a predetermined length using the moving-type disc cutter 35 and the fixed cutter 36 fixed to the device.

Then a presser member moving means which retracts the presser member 37 to a standby position when the medium 22 is fed to the cutting position of the disc cutter 35 and fixed cutter 36, and moves the presser member 37 to a position where the presser member 37 presses on the medium 22 to fix the same when the medium 22 is fed to the cutting position will be described in detail mainly referring to FIGS. 1A, 1B, 2A and 2B.

Figure 1A:
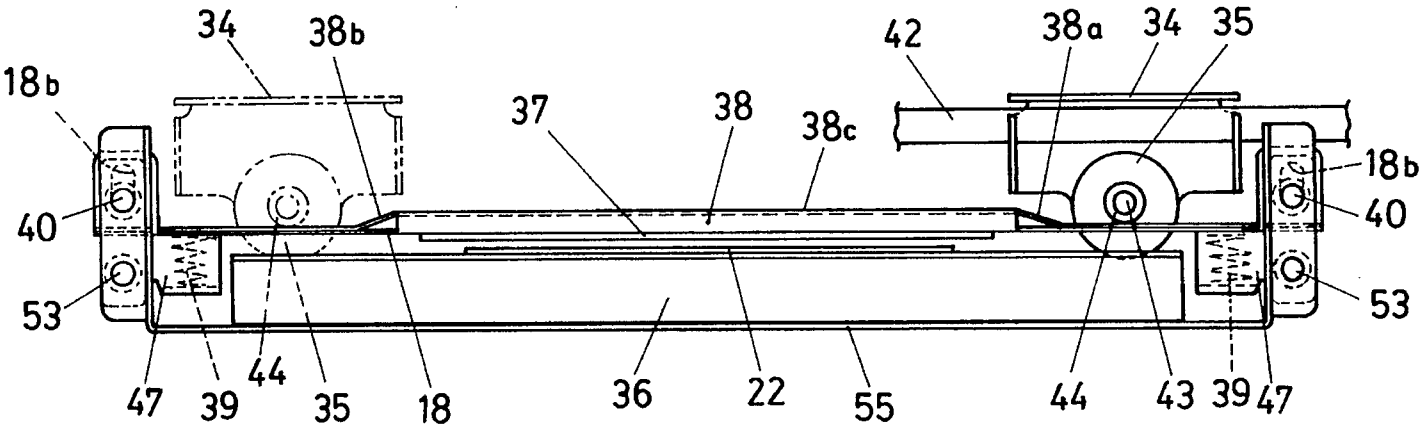
FIGS. 1A and 1B are front views of a cutting device according to a first embodiment of the invention before and during cutting the medium respectively.
Figure 1B:
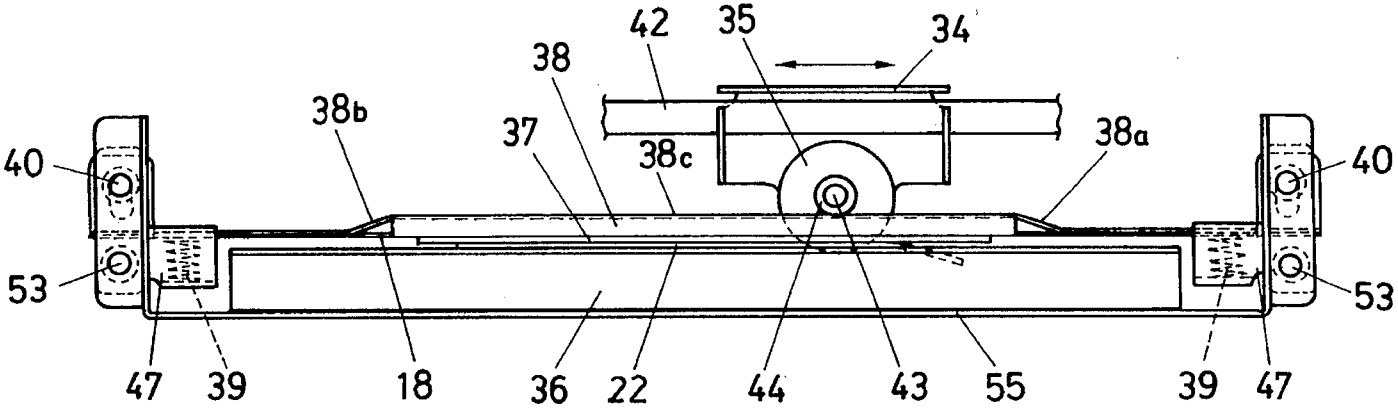

The presser member 37 is fixedly mounted on the lower surface of the bracket 18 as illustrated in FIGS. 1A and 1B, and the bracket 18 has mounting plates at both ends thereof, the mounting plates respectively having long holes 18*a* and 18*b* formed therein.

The presser member 37 is held by fixing screws 40 and 40 which are stepped screws for fixing the presser member 37 to left and right spring receiving frames 47 and 47 at both ends of the presser member 37 together with the cutter frame 55 (also refer to FIG. 2) in such a way as to be vertically movable between a position where the fixing screws 40 and 40 are in contact with the upper end of the long holes 18*a* and 18*b* and that where the fixing screws 40 and 40 are in contact with the lower end of the long holes 18*a* and 18*b* respectively.

The lower sides of the left and right spring receiving frames 47 and 47 are fixed to the cutter frame 55 by the screws 53 and 53 respectively.

The bracket 18 extends from right to left in the moving direction of the disc cutter 35 in FIG. 1A and the presser member interlocking plate 38 serving as a presser member interlocking member is fixedly mounted on the upper surface of the bracket 18 integrally therewith to be symmetrical with respect to the longitudinally central point of the bracket 18.

The above-mentioned spring receiving frames 47 and 47 respectively fixed to the cutter frame 55 are provided between the left and right mounting plates of the bracket 18 and the cutter frame 55 and compression coil springs 39 and 39 are respectively mounted between the upper surfaces of the spring receiving frames 47 and 47 and the lower surfaces of the bracket 18 at a position close to the both ends thereof.

In a normal state wherein external force pushes down the bracket 18, each of the compression coil springs 39 and 39 pushes up the bracket 18 so that the lower ends of the long holes 18*a* and 18*b* are in contact with the fixing screws 40 and 40 respectively as illustrated in FIG. 1A.

Accordingly in this state, it is possible to feed the medium 22 by the feed roller pair 23 while being guided by a lower guide plate 41 through a gap between the presser member 37 which is pushed up together with the bracket 18 and the fixed cutter 36.

The disc cutter 35 is rotatably mounted on the shaft 43 by way of the bearing 52 and the shaft 43 is fixed to the carriage 34.

The carriage 34 holds the disc cutter 35 relative to the fixed cutter 36 in a positional relationship suitable for cutting the medium 22, and a timing belt 42 is fixed to the carriage 34 in such a way as to pierce the both side surfaces thereof as illustrated in FIGS. 1A and 1B.

The timing belt 42 is driven normally or reversely by a driving source, not shown, to reciprocate the disc cutter 35 together with the carriage 34 along the fixed cutter 36 left and right in FIG. 1A.

A bearing 44 which is an engaging member moved in the cutting direction together with the disc cutter 35 to cut the medium 22 therewith is rotatably mounted on the shaft 43 to which the disc cutter 35 is fixed corresponding to the presser member interlocking plate 38.

When the disc cutter 35 is moved to the cutting side as illustrated in FIG. 1B, the lower portion of the peripheral surface of the bearing 44 is brought into contact with the stage 38*c* heaping one step at the central portion of the presser member interlocking plate 38 to push down the stage 38*c* so that the presser member 37 fixed to the lower surface of the presser member interlocking plate 38 presses on the medium 22 to fix the same at a position close to the cutting position.

Accordingly, the presser member interlocking plate 38 which travels interlocking with the cutting operation of the disc cutter 35 while engaging with the bearing 44 at the time of cutting the medium 22 moves the presser member 37 to a position where the same presses on the medium 22 to fix the same.

Moreover, the presser member interlocking plate 38 is pushed up by the compression coil springs 39 and 39 which are biasing members to be in contact with the bearing 44 at the upper surface thereof so that the presser member 37 may be at a standby position in the figure when the disc cutter 35 stops at either of the positions represented by solid and chain lines in FIG. 1A where the disc cutter 35 does not cut the medium 22.

Accordingly in this embodiment, the bracket 18, the presser member interlocking plate 38, the bearing 44 mounted on the shaft 43 and two compression coil springs 39 and 39 correspond to the presser member moving means which retracts the presser member to a standby position when the medium is fed to the cutting position of the disc cutter and fixed cutter, and moves the presser member to a position where the presser member presses on the medium to fix the same when the medium is fed to the cutting position to be cut.

The cutting device 21 turns the timing belt 42 by rotating a cutter motor, not shown, when the medium 22 which has been fed to the cutting position is successively cut by a predetermined length so as to move the carriage 34 along the edge of the fixed cutter 36, which extends in the cutting direction, from the position represented by a solid line to that represented by a chain line or to the contrary from the position represented by the chain line to that represented by the solid line.

When the bearing 44 rotatably mounted on the shaft 43 fixed to the carriage 34 reaches the inclined surface 38*a* of the presser member interlocking plate 38 as the result of movement of the carriage 34, the bearing 44 which is rotationally brought into contact with the inclined surface 38*a* pushes down the presser member interlocking plate 38 and consequently the presser member 37 fixed to the lower surface of the presser member interlocking plate 38.

Figure 2A:
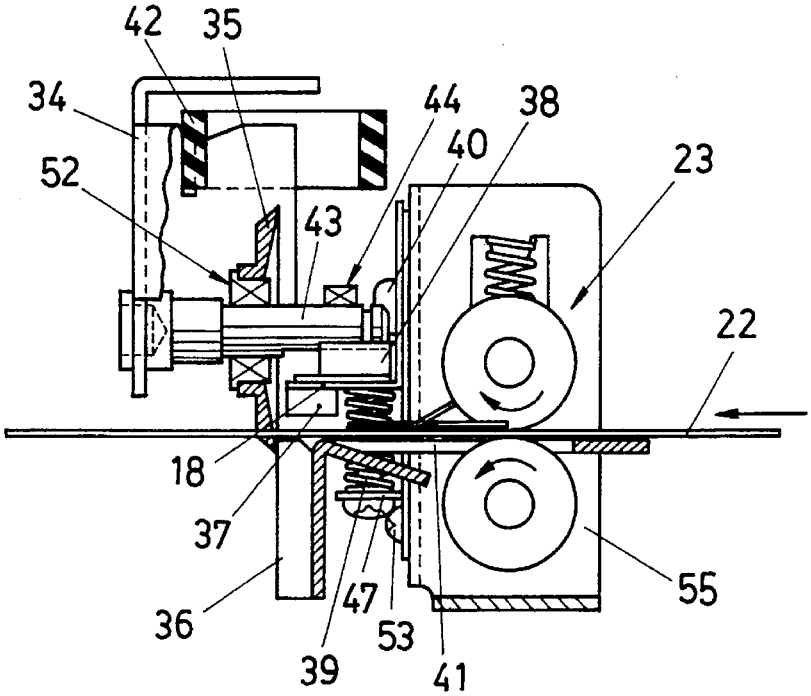
FIGS. 2A and 2B are side views of the cutting device in FIG. 1 before and during cutting the medium respectively.
Figure 2B:
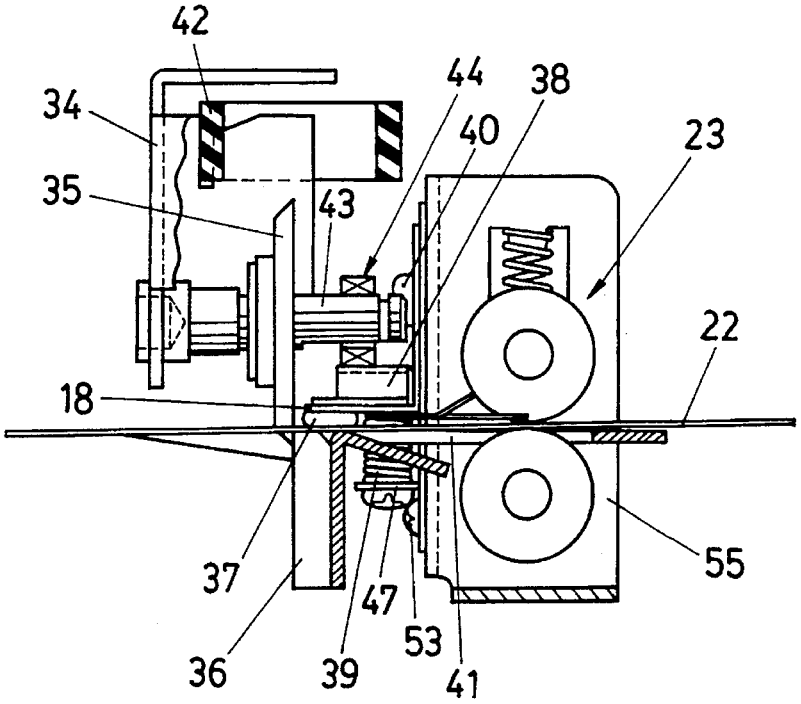

As a result, the medium 22 which has been fed to the cutting position to be cut is pushed against the upper surfaces of the tip end portion of the lower guide plate 41 at a position close to the cutting position and to the fixed cutter 36 by the presser member 37 as illustrated in FIG. 2B and the medium 22 is cut between the fixed cutter 36 and the disc cutter 35 which moves to the left in FIG. 1B.

The presser member 37 presses on the medium 22 until the bearing 44 passes the inclined surface 38*b* of the presser member interlocking plate 38 as represented by the chain line in FIG. 1A.

As described above, since the cutting device 21 presses on the medium 22 to fix the same at a position close to the cutting position with the presser member 37 when it cuts the medium 22 with the disc cutter 35 and the fixed cutter 36, even if force is applied to the surface of the medium to deform the same in the outward direction of the surface which is perpendicular to the surface of the medium indicated by an arrow Z in FIG. 3 due to resistance generated by the disc cutter 35 moving to cut the medium 22, the deformation of the medium 22 can be restrained.

As a result, the cut edge of the medium 22 which has been cut by the cutting device 21 can be straight neatly.

Whereas if cloth label etc. is used for the medium 22, the medium 22 is liable to be charged with electricity when the heat transfer ribbon 28 stuck to the medium 22 being heated under pressure by the thermal head 24 in printing process is peeled off therefrom by the ribbon peel-off plate 32.

The print medium such as the cloth label is comparatively low in rigidity in the direction (the direction indicated by an arrow Z in FIG. 3) perpendicular to the surface of the medium.

Figure 4:
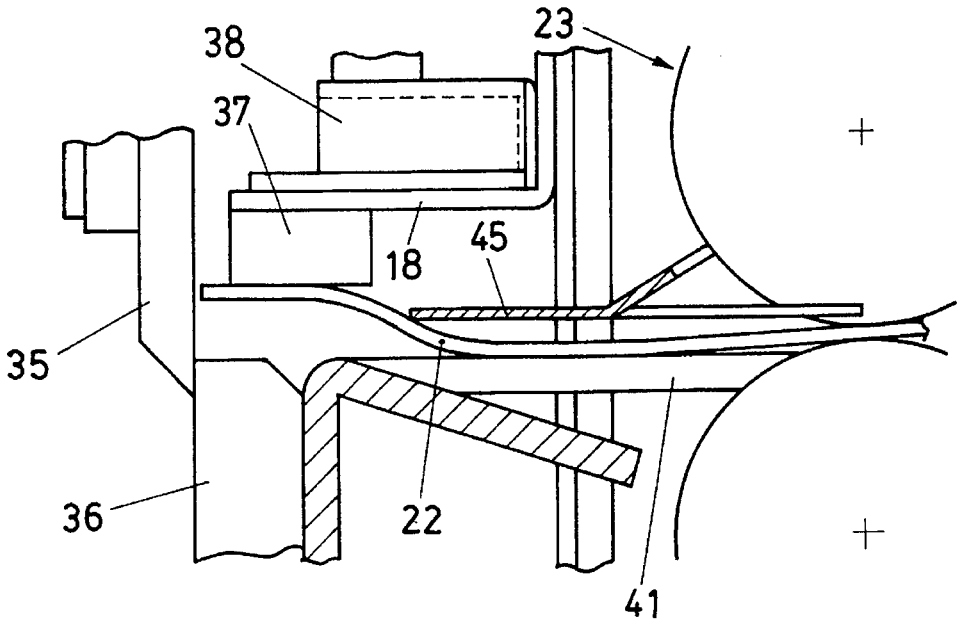
FIG. 4 is an enlarged view of a medium comparatively low in rigidity such as cloth label etc. for explaining the deformation thereof after it passes an upper guide plate 45.

Accordingly, although the upper and lower guide plates 45 and 41 restrain the deformation of the medium 22 in the direction of low rigidity set forth above, they cannot restrain it after the medium 22 passes the upper guide plate 45, so that the medium 22 is liable to be deformed at the tip end portion thereof which has passed the upper guide plate 45 as illustrated in FIG. 4.

In this case, if the contact surface of a member such as the presser member 37 is made of material which is comparatively liable to stick other material by static electricity, the medium 22 is liable to stick the presser member 37 or other materials at a position close to the same when the former is brought into contact with the latter, causing trouble in feeding.

Therefore, if the contact portions of the presser member 37 or members which are located adjacent thereto so that they can be brought into contact with the medium 22 are made of either of or a combination of more than two of elastic materials such as conductive felt, urethane foam, rubber, sponge and the like each having electrical conductivity, is electrically coupled to the cutting device body made of electric conductor, it is possible to always feed the medium 22 smoothly even if the medium 22 is charged with electricity since the medium 22 can discharge the electricity when it is brought into contact with a conductive elastic member such as the presser member 37 etc.

Figure 5:
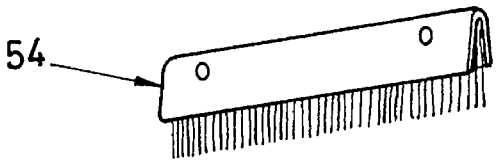
FIG. 5 is a perspective view showing an example of a static eliminator brush for eliminating static electricity from an electrified medium.
Figure 6:
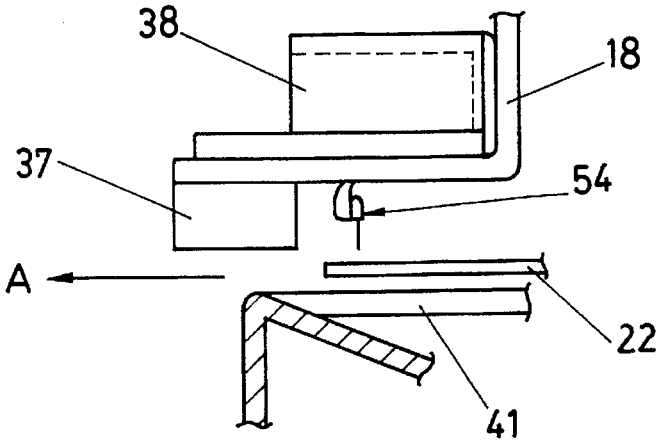
FIG. 6 is a schematic view of a cutting device on which the static eliminator brush in FIG. 5 is mounted.

Moreover, if a self-discharging static eliminator 54 such as a static eliminator brush etc. as illustrated in FIG. 5 is provided upstream the presser member 37 with regard to the feeding path of the medium, the longitudinal direction of the self-discharging static eliminator 54 being arranged perpendicular to the feeding direction of the medium 22 indicated by an arrow A in FIG. 6, i.e., the face-to-back direction in the figure, the static eliminator brush can more effectively eliminate static electricity from the fed medium 22 which has been fed being charged with electricity.

Second Embodiment (FIGS. 7–12)

A cutting device according to a second embodiment of the invention will be described with reference to FIGS. 7 to 12.

In FIGS. 7 to 11, elements corresponding to those in FIGS. 1 to 3 are denoted at the same numerals and the description thereof is omitted.

Figure 7:
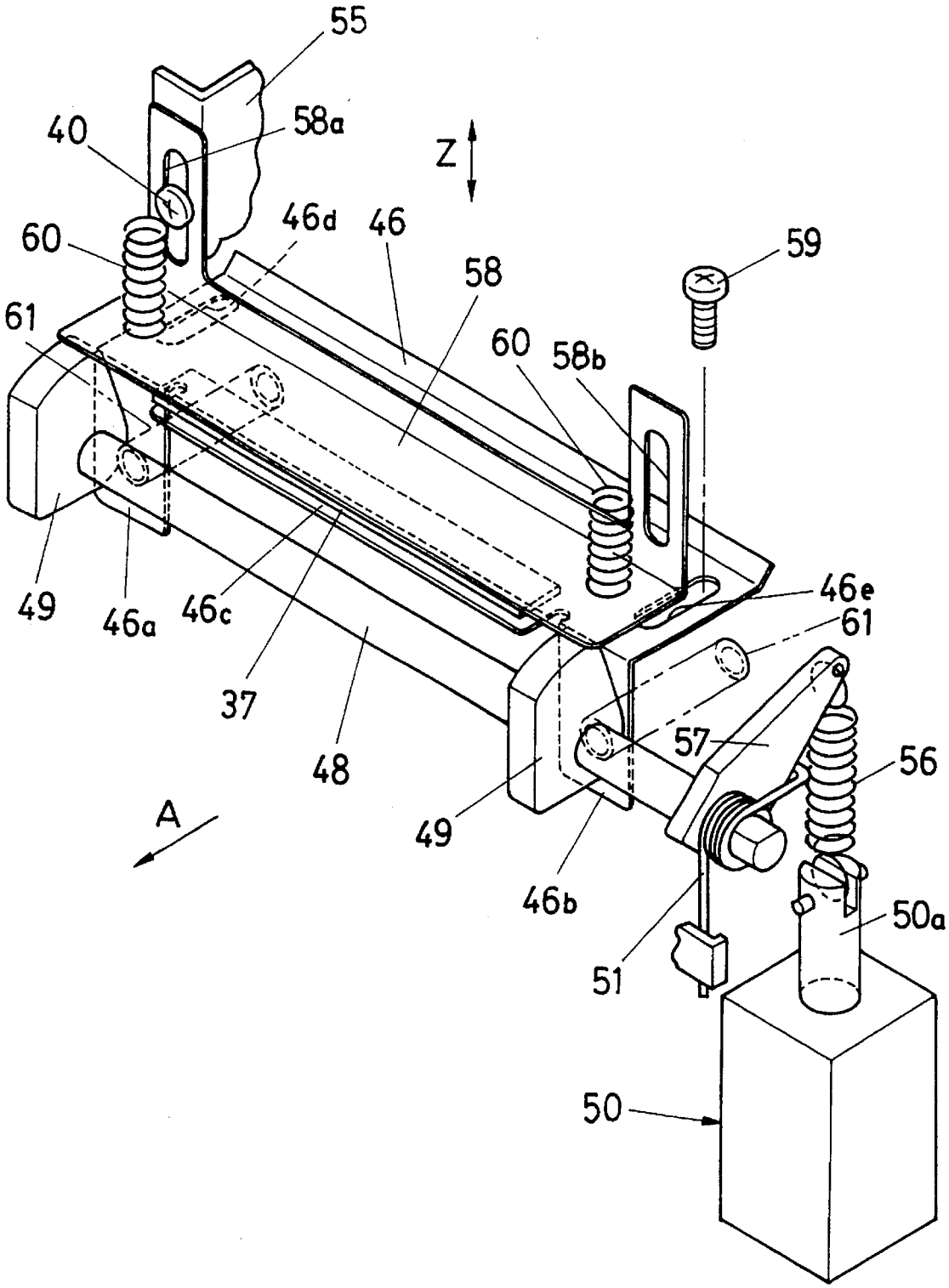
FIG. 7 is a perspective view of a cutting device according to a second embodiment of the invention.

The cutting device comprises a bracket 58 to the lower surface of which a presser member 37 is fixed and which has long holes 58*a* and 58*b* formed in the mounting plates at the both longitudinal end portions thereof and fixing screws 40 and 40 which are stepped screws inserted into the long holes 58*a* and 58*b* respectively as illustrated in FIG. 7 similarly to the bracket 18 illustrated in FIGS. 1A and 1B. FIG. 7 omits showing a fixing screw 40 on the side of the long hole 58b.

The fixing screws 40 and 40 are screwed to fix the bracket 58 to the cutter frame 55 so as to be movable only in the direction indicated by an arrow Z within a range wherein the long holes 58*a* and 58*b* on both sides of the bracket 58 restricted by the fixing screws 40 and 40 respectively.

Cams 49 and 49 are provided at the positions corresponding to the both end portions of the lower surface of the bracket 58 and the cams 49 and 49 are fixed to the both ends of a shaft 48 which extends in parallel to the longitudinal direction of the bracket 58 and is rotatably journaled by the fixed portion of the cutting device to be identical in phase with each other in the rotating direction.

Figure 8:
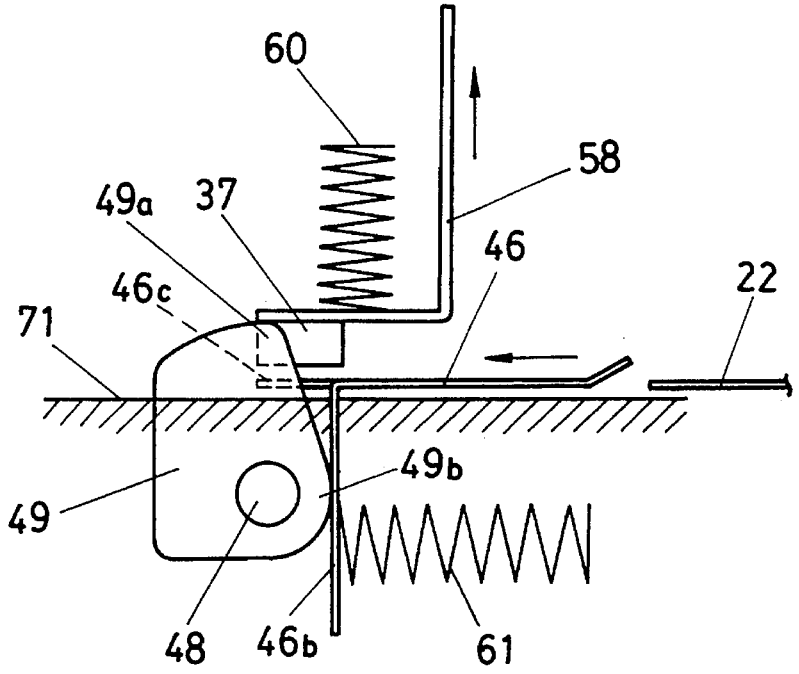
FIG. 8 is a schematic view of the cutting device in which a presser member is separated from a medium by a separating guide member which is a characteristic portion of the cutting device in FIG. 7.

A separation guide plate 46 which is a separating guide member is provided on the lower surface of the bracket 58 upstream the cams 49 and 49 with regard to the feeding path on the right side in the figure as illustrated in FIG. 8.

The separation guide plate 46 advances between the presser member 37 and the medium 22 to separate the former from the latter for guiding the same in the feeding direction so as to prevent contact therebetween when the medium 22 is fed to the cutting position of the disc cutter 35 and fixed cutter 36.

The separation guide plate 46 retracts interlocking with the cutting operation of the medium 22 to release the separation of the presser member 37 from the medium 22 when the same is fed to the cutting position to be cut.

The separation guide plate 46 formed of a plate member which extends along the bracket 58 substantially as long as the same comprises spring receivers 46*a* and 46*b* at both sides of the feeding downstream end thereof and a separation plate portion 46*c* formed between the spring receivers 46*a* and 46*b* for separating the presser member 37 from the medium 22 as illustrated in FIG. 7.

Figure 10:
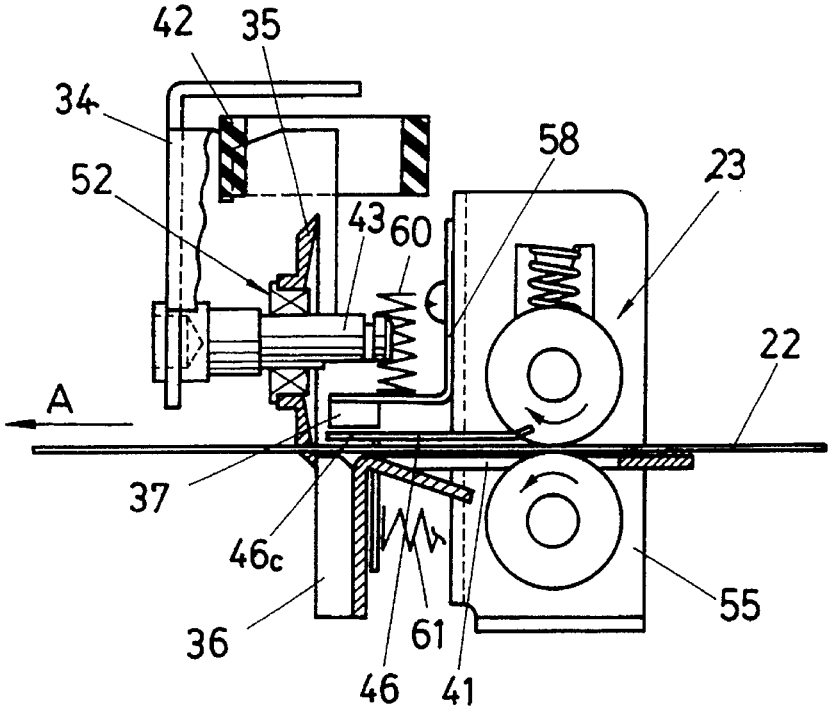
FIG. 10 is a side view of the cutting device in FIG. 7 before cutting the medium.

Long holes 46*d* and 46*e* are formed at both end portions of the fiat guide surface of the separation guide plate 46 along the feeding direction of the medium 22 and screws 59 and 59 which are stepped screws (the illustration of that on the side of the long hole 46*d* is omitted in the figure) are screwed into the lower guide plate 41 through the long holes 46*d* and 46*e* respectively to fix the separation guide plate 46 to the lower guide plate 41 (FIG. 10).

Figure 11:
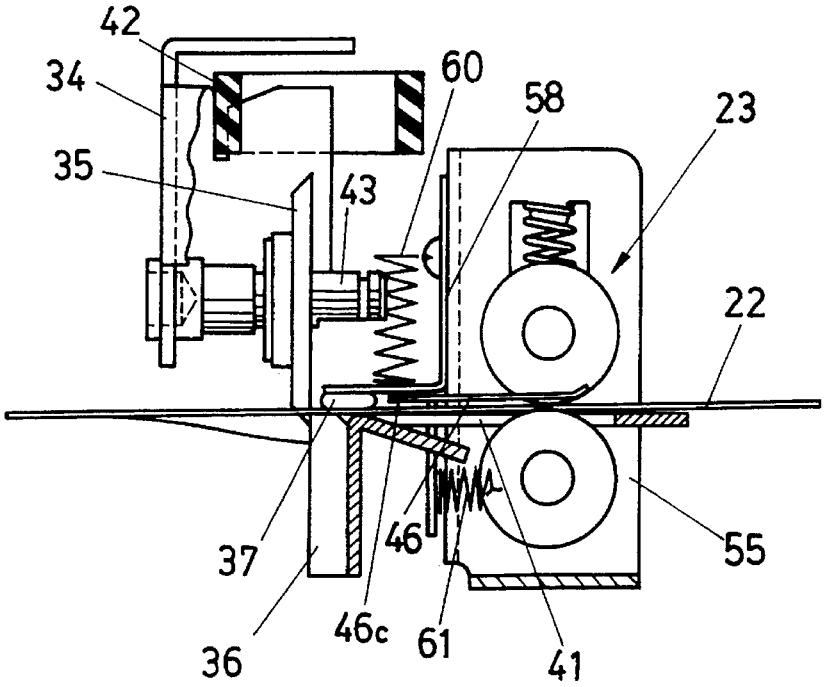
FIG. 11 is a side view of the cutting device in FIG. 7 during the cutting of the medium.

The separation guide plate 46 is movable left and fight between the position where the separation plate portion 46*c* on the tip end of the separation guide plate 46 advances between the presser member 37 and the medium 22 to guide the latter in the feeding direction indicated by an arrow A separating the former from the latter so as to prevent contact therebetween illustrated in FIG. 10 and a position to which the separation plate portion 46*c* retracts to release the separation of the presser member 37 from the medium 22 as illustrated in FIG. 11.

The separation guide plate 46 is always forced in the direction of an arrow A by the biasing force of compression coil springs 61 and 61 mounted between the spring receivers 46*a* and 46*b* on both sides thereof and the fixed portion of the cutting device as illustrated in FIG. 7.

Compression coil springs 60 and 60 are similarly mounted also between the both end portions of upper surface of the bracket 58 and the fixed portion of the cutting device.

As a result, when the cams 49 and 49 are turned to the positions illustrated in FIG. 8, the spring receivers 46*a* and 46*b* are pressed on the cams 49 and 49 on the left surfaces thereof in the figure, while the bracket 58 similarly presses on the cams 49 and 49 at the lower surfaces of both end portions of the lower surface thereof to which the presser member 37 is fixed.

An arm 57 is fixed to one end portion of the shaft 48 to which the cams 49 and 49 are fixed at one end thereof and is connected to the movable shaft 50*a* of a solenoid 50 by way of a tension coil spring 56 at the other end thereof as illustrated in FIG. 7.

A tension coil spring 51 which is in contact with the fixed portion of the cutting device at one end thereof and the side edge of the arm 57 at the other end thereof is mounted on the shaft 48 by fitting the coiled portion thereof onto the shaft 48 to always force the arm 57 to turn counterclockwise in FIG. 7 and a stopper, not shown, restrains the turning position of the cams 49 and 49 to the positions illustrated in FIG. 8 when the solenoid 50 is not actuated.

In the cutting device, the cams 49 and 49 are turned to the positions illustrated in FIG. 8 being urged by the tension coil spring 51 set forth above when the medium 22 is fed to the cutting position of the disc cutter 35 and fixed cutter 36.

In this state, the large eccentric portions 49*a* of the cams 49 and 49 push up the bracket 58 to form a gap between a lower guide surface 71 (FIG. 8) formed of the upper surfaces of the lower guide plate 41 and the fixed cutter 36 (refer to FIG. 10 with regard to both) and the presser member 37 fixed to the lower surface of the bracket 58.

At that time, since the separation guide plate 46 is forced to the left in FIG. 8 by the biasing force of the compression coil springs 61 and 61 to be in contact with the small eccentric portions 49*b* of the cams 49 and 49 at the left surface thereof, the separation plate portion 46*c* at the tip end thereof enters between the lower guide surface 71 and the presser member 37 to shelter the same, so that the medium 22 to be cut is smoothly fed between the lower guide surface 71 and the separation guide plate 46 which also serves as an upper guide surface.

Figure 9:
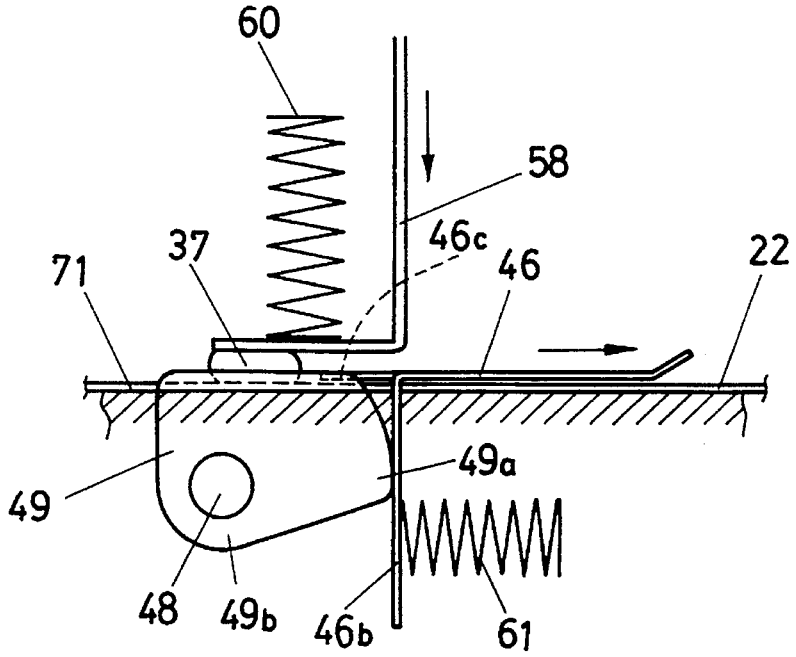
FIG. 9 is a schematic view of the cutting device in which the separation of the presser member by way of a separation guide plate in FIG. 8 is canceled.

When the medium 22 is cut, the solenoid 50 in FIG. 7 is turned on to turn the arm 57 clockwise so as to turn the cams 49 and 49 at both sides of the shaft 48 to the positions illustrated in FIG. 9 by way of the shaft 48.

Then the bracket 58 is pressed down by the biasing force of the compression coil springs 60 and 60, so that the presser member 37 fixed to the lower surface of the bracket 58 presses on the medium 22, which has been fed to a predetermined cutting position on the lower guide surface 71, to temporarily fix the same.

Since the separation guide plate 46 is moved to the right in FIG. 9 against the biasing force of the compression coil springs 61 and 61 when the cams 49 and 49 are brought into contact with the left surfaces of the spring receivers 46*a* and 46*b* of the separation guide plate 46 at the large eccentric portions 49*a* thereof, the separation plate portion 46*c* at the tip end of the separation guide plate 46 gets out of the gap between the lower guide surface 71 and the presser member 37 to release the presser member 37 from being sheltered.

As a result, when the presser member 37 lowers, it does not interfere with the separation plate portion 46*c*.

According to this embodiment, the presser member moving means which presses on the medium 22 at a position close to the cutting position when it is cut is provided with the solenoid 50 that is a driving source driven at an indicated timing and a moving means for moving the presser member 37 to the position where the same presses on the medium to fix the same at a position close to the cutting position and to the standby position.

The moving means is composed of the solenoid 50, the cams 49 and 49, the bracket 58, the compression coil springs 60 and 60 etc.

Figure 12:
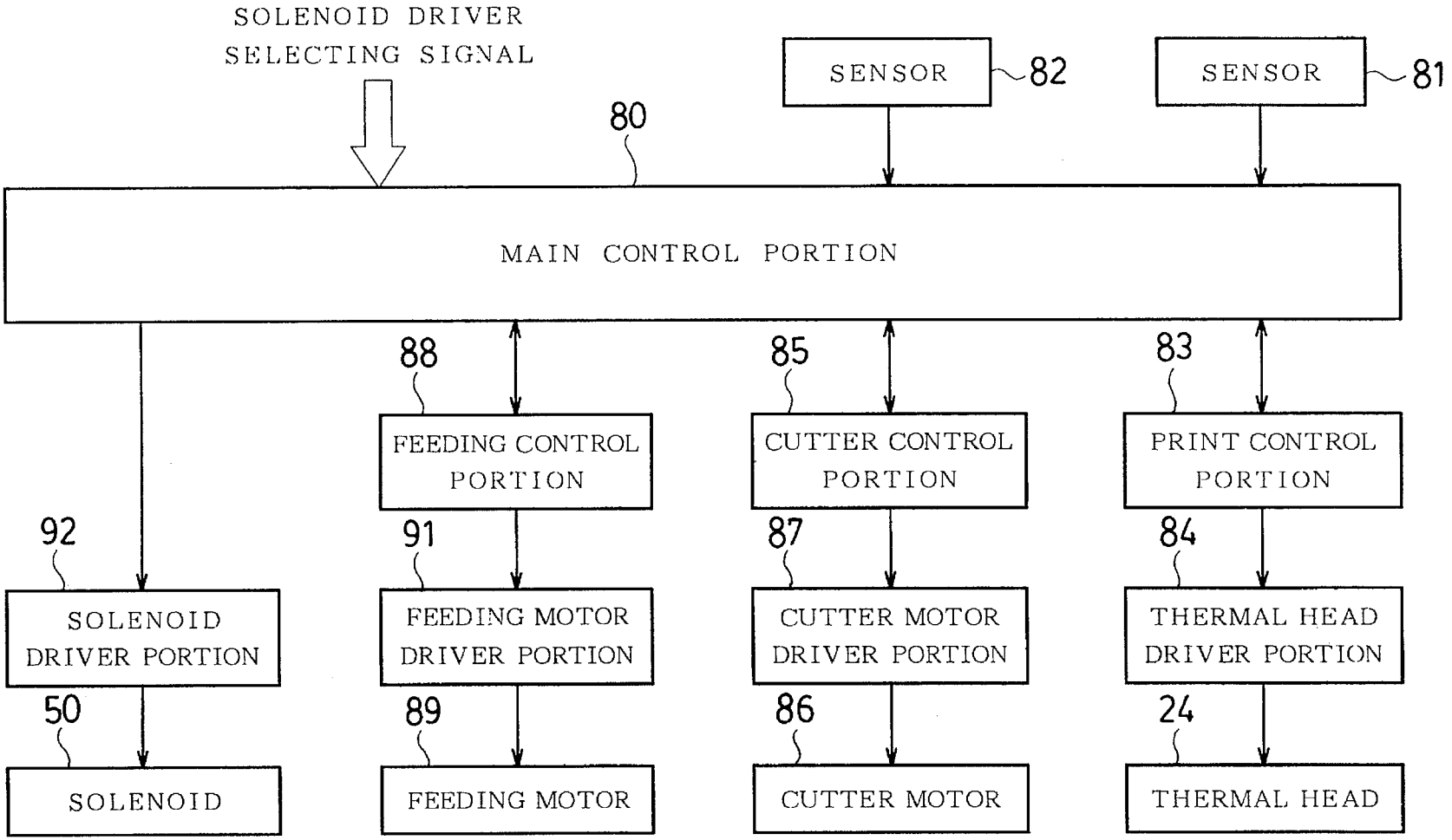
FIG. 12 is a schematic block diagram showing only an essential portion of a control system for a printing device equipped with the cutting device according to the second embodiment illustrated in FIGS. 7 to 11.

The presser member moving means also comprises a main control portion 80 illustrated in FIG. 12 which functions as a control means for moving the presser member 37 from the standby position to the position where it presses on the medium 22 to fix the same by driving the solenoid 50 set forth above that is the moving means interlocking with the cutting operation of the medium 22 by the disc cutter 35 that is a moving cutter.

The main control portion 80 composed of a microcomputer receives detection signals from sensors 81 and 82, not shown, the detecting portions of which are turned on or off by the carriage 34 illustrated in FIG. 10 as the same travels. The sensors 81 and 82 are transmission-type photosensors.

The main control portion 80 receives a solenoid driving selection signal from a selection key provided on a control panel, not shown, when the selection key is pushed down.

The selection key is used when an operator selects whether the pressing-on operation of the medium is performed by operating the solenoid 50 or not depending on the kind of used medium.

The main control portion 80 exchanges signals between a print control portion 83 and itself, and the print control portion 83 supplies a signal for performing printing to a thermal head driver portion 84 based on a print information supplied by the main control portion 80.

The main control portion 80 also exchanges signals between a cutter control portion 85 and itself, and the cutter control portion 85 supplies a signal for driving a cutter motor 86 which moves the carriage 34 of the cutting device to a cutter motor driver portion 87.

Moreover, the main control portion 80 also exchanges signals between itself and a feeding control portion 88 which controls driving various feeding systems of the printing device, and the feeding control portion 88 supplies a signal for operating a feeding motor 89 to a feeding motor driver portion 91 to drive the feeding motor 89.

When the main control portion 80 receives a detection signal of the carriage 34 from the sensor 81 during it receives the solenoid driving selection signal set forth above, it supplies a signal for turning on the solenoid 50 to a solenoid driver portion 92 and similarly when it receives the detection signal of the carriage 34 from the sensor 82, it turns off the solenoid 50.

There is, for example, a method of moving the presser member 37 from the standby position to the position where it presses on the medium 22 to fix the same by turning on the solenoid 50 interlocking with the cutting operation of the disc cutter 35 and returning the presser member 37 again to the standby position by turning off the solenoid 50 after cutting the medium 22, as described hereinafter.

That is, the sensor 81 is disposed at a position where it can detect the carriage 34 when the bearing 44 reaches the position corresponding to the inclined surface 38*a* of the presser member interlocking plate 38 illustrated in FIG. 1 and the sensor 82 is disposed at a position where it can detect the carriage 34 when the bearing 44 reaches the position corresponding to the inclined surface 38*b* of the presser member interlocking plate 38.

The main control portion 80 can control the solenoid 50 in such a way as to turn on the same when the sensor 81 detects the carriage 34 for the first time during the travel from the home position thereof on the left side in FIG. 7 in the cutting direction together with the disc cutter 35 and turn off the solenoid 50 when the sensor 82 detects the carriage 34 thereafter.

Moreover, since the solenoid 50 can be selectively turned on or off depending on the kind of medium according to this embodiment, the operation of pressing on the medium can be selectively performed depending on the kind of medium such as cutting the medium without turning on the solenoid 50 in case there is no need to press on the medium to fix the same at a position close to the cutting position as the medium has a high rigidity in the direction (the direction indicated by an arrow Z in FIG. 3) perpendicular to the surface of the medium.

Furthermore, since the separation plate portion 46*c* of the separation guide plate 46 enters between the lower guide surface 71 and the presser member 37 to shelter the same when the medium 22 is fed to the cutting position as illustrated in FIG. 8, even if the medium 22 which has been fed to the cutting device after printing is charged with electricity, it can be prevented from sticking to the presser member 37 with certainty so that it can be fed smoothly.

Figure 13:
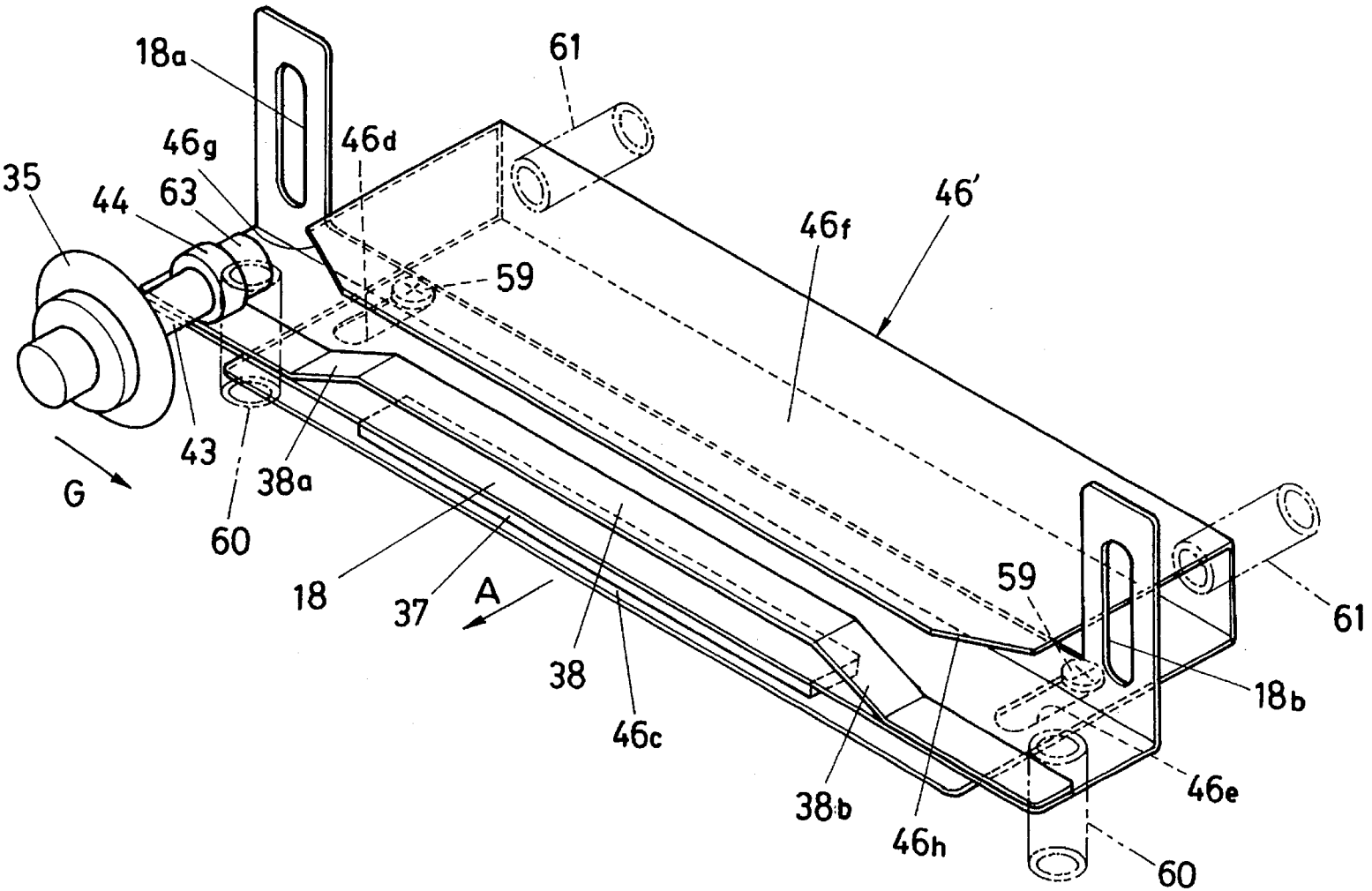
FIG. 13 is a perspective view of a cutting device according to a third embodiment of the invention provided with a mechanism for moving the separation guide plate interlocking with the movement of a disc cutter.
Figure 14:
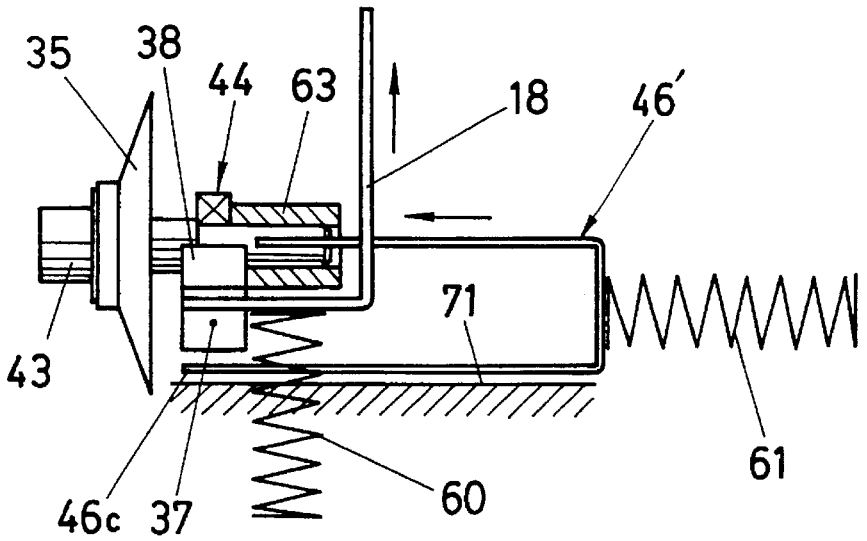
FIG. 14 is a side view of the cutting device in FIG. 13 in which the separation guide plate separates the presser member from the medium.
Figure 15:
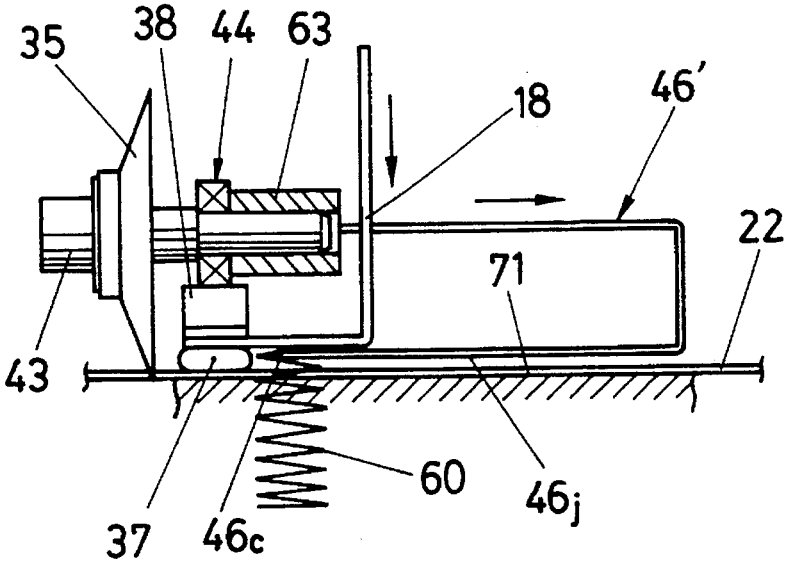
FIG. 15 is a side view of the cutting device in FIG. 13 in which the separation of the presser member by way of the separation guide plate is canceled.

Third Embodiment (FIGS. 13–15)

FIGS. 13 to 15 show a cutting device according to a third embodiment of the invention provided with a mechanism for moving the separating guide plate to the position where the presser member is sheltered and the position where the presser member is exposed interlocking with the movement of the disc cutter, wherein elements corresponding to those in FIGS. 7 to 11 are denoted at same numerals.

The cutting device comprises a separation guide plate 46' which substantially has a shape of U laid on its side in a side view to form an upper surface portion 46*f* having inclined portions 46*g* and 46*h* at the both end edges on the downstream side thereof with regard to the feeding direction different from the separation guide plate 46 in the embodiment illustrated in FIG. 7.

The separation guide plate 46' is movable only in the direction indicated by an arrow A and in the reverse direction thereof by way of screws 59 and 59 engaged in the long holes 46*d* and 46*e* respectively to be relatively movable therein.

The separation guide plate 46' projects to the position illustrated in FIG. 14 at the separation plate portion 46*c* thereof where the upstream end of long holes 46*d* and 46*e* regarding to the feeding direction are in contact with the screws 59 and 59 respectively urged by the compression coil springs 61 and 61 when the bearing 44 is outside the inclined surface 38*a* of the presser member interlocking plate 38 where the disc cutter 35 does not cut the medium 22 and when the bearing 44 is outside the inclined surface 38*b* thereof on this side as illustrated in FIG. 13.

When cutting the medium starts by moving the disc cutter 35 from the position illustrated in FIG. 13 in the direction of an arrow G, a sintered bearing 63 mounted on the shaft 43 to be unmovable in the axial direction thereof by way of a drop-off prevention member, not shown, is brought into contact with the inclined portion 46*g* of the separation guide plate 46' to push off the same, so that the separation guide plate 46' moves to the direction reverse to that of the arrow A and stops when the sintered bearing 63 passes the inclined portion 46*g*.

At that time, the separation guide plate 46' is displaced right from the position illustrated in FIG. 14 so that the tip end portion of the separation plate portion 46*c* that is the left end thereof in the figure is positioned right relative to the presser member 37.

Since the bearing 44 illustrated in FIG. 13 is brought into contact with the inclined surface 38*a* of the presser member interlocking plate 38 to push down the same substantially at the same time when the separation plate portion 46*c* retracts from the position of the presser member 37 as described above, the presser member 37 lowers until it presses on the medium 22 to fix the same at a position close to the cutting position, the medium 22 having been fed to the cutting position between the lower guide surface 71 and the guide surface 46*j* of the separation guide plate 46'.

The disc cutter 35 moves in the direction indicated by an arrow G in FIG. 13 while fixing the medium 22 to cut off a piece of a predetermined length straight therefrom, and when the bearing 44 reaches the inclined surface 38*b* of the presser member interlocking plate 38, the presser member 37 is lifted together with the bracket 18 to release the medium 22 from being pressed on.

The disc cutter 35 further continues to move until the sintered bearing 63 reaches the inclined surface 46*h* of the separation guide plate 46', when the separation guide plate 46' as a whole projects to return to the position where it shelters the presser member 37 again at the separation plate portion 46*c* thereof due to the biasing force of the compression coil springs 61 and 61 as illustrated in FIG. 14.

As described above, it is possible to interlock the vertical movement of the presser member 37 and the forward and backward movement of the separation guide plate 46' with the cutting operation of the disc cutter 35 so as to completely shelter the presser member 37 by the separation plate portion 46*c* of the separation guide plate 46' when the medium 22 is fed to the cutting position in the cutting device after printing is performed thereon, so that even if the medium 22 is charged with electricity, it can be fed with certainty without electrostatically sticking to the presser member 37.

Figure 16:
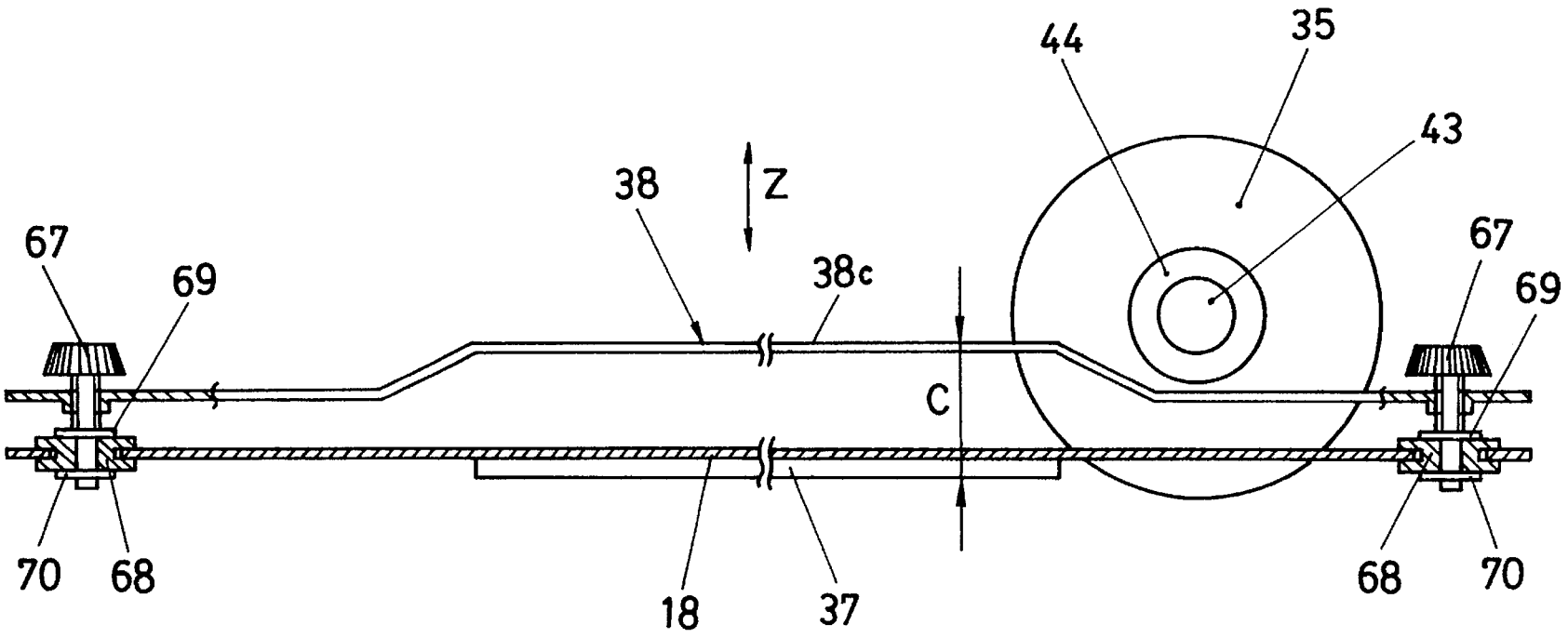
FIG. 16 is a front view of a cutting device according to a fourth embodiment of the invention in which pressure applied to the medium by the presser member is adjustable.

Fourth Embodiment (FIG. 16)

FIG. 16 is a front view of a cutting device according to a fourth embodiment of the invention wherein the presser member can adjustably press on the medium. Elements corresponding to those in FIG. 1 are denoted at same numerals.

According to this embodiment, screw holes are formed at both end portions of the presser member interlocking plate 38 which extends widthwise the medium in the direction perpendicular to the feeding direction thereof and thumb screws 67 and 67 are screwed therethrough to be fit into bushes 68 and 68 at the tip end portions thereof, the bushes 68 and 68 being fixed to the both end portions of the bracket 18 respectively.

Stop rings 69 and 70 are fixed to of each thumb screw 67 at positions thereof which correspond to the upper and lower surfaces of each bush 68 so as to prevent the thumb screw 67 from dropping off from the bush 68, thereby to hold the presser member interlocking plate 38 on the bracket 18 to the lower surface of which the presser member 37 is fixed.

As a result, when the thumb screws 67 and 67 at the both end portions of the presser member interlocking plate 38 are rotated in the same direction by the same rotating amount, the presser member interlocking plate 38 with which engages with the thumb screws 67 and 67 at the screwed portions thereof is vertically displaced by a distance corresponding to the rotating amount of the thumb screws 67 and 67 in FIG. 16, so that it is possible to arbitrarily change the distance C between the upper surface of the stage 38*c* of the presser member interlocking plate 38 and the lower surface of the presser member 37.

Adjusting the distance C can change the lower limit of position of the presser member 37 to adjust the pressure applied to the medium 22 by the presser member 37 to press on and fix the former.

The displacement amount of the presser member 37 by which the presser member 37 is further lowered after it is brought into contact with the medium 22 when the presser member 37 presses on the medium 22 can be obtained by subtracting the clearance between the lower surface of the presser member 37 and the lower guide surface 71 (refer to FIG. 14) at the time before the presser member interlocking plate 38 is lowered from the displacement amount in the direction of Z of the presser member interlocking plate 38 which is pressed down by the bearing 44 and adding the thickness of the medium 22 thereto.

If a pressure adjusting mechanism using such thumb screws and a member having screw holes which engage with the thumb screws is adopted to the embodiment which has been described with reference to FIGS. 8 and 9, i.e., the presser member interlocking plate 38 illustrated in FIG. 16 is fixed to the bracket 58 by way of the thumb screws 67 and 67 at a position corresponding to the bearing 44, it is possible to adjust the pressure applied to the medium 22 by the presser member 37 in the same way.

Figure 17:
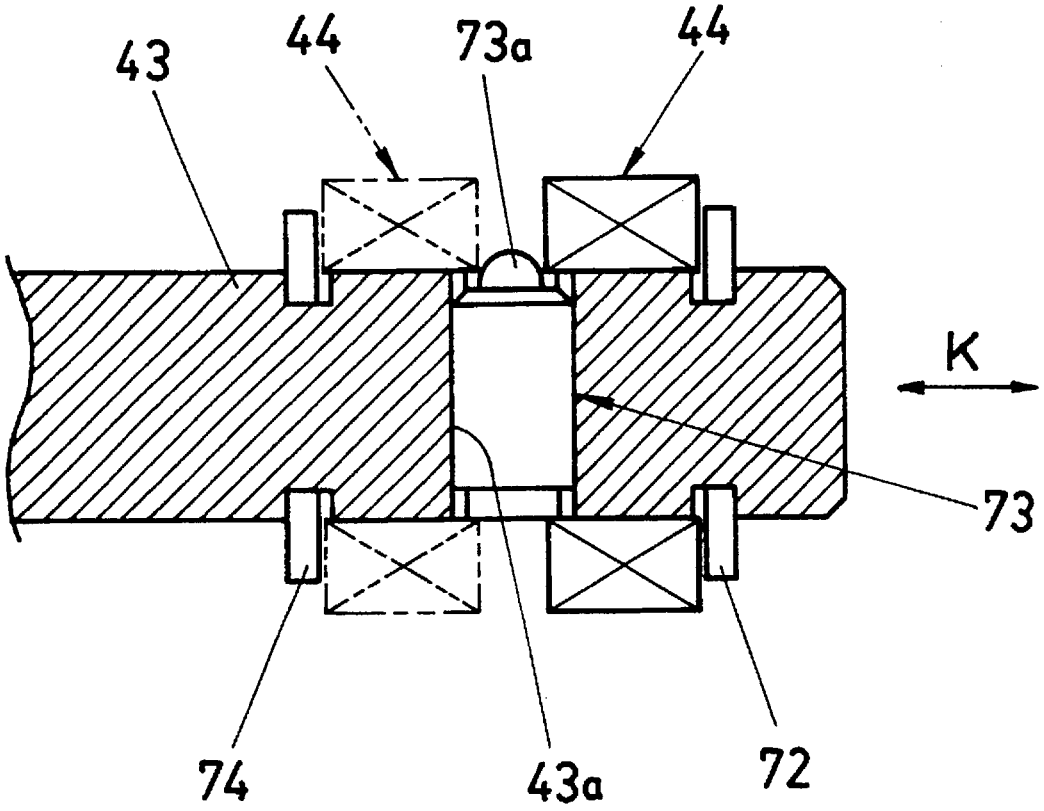
FIG. 17 is a front view of a cutting device according to a fifth embodiment of the invention provided with a switching mechanism which can cancel the pressure applied to the medium by the presser member interlocking with the cutting operation of the disc cutter.
Figure 18:
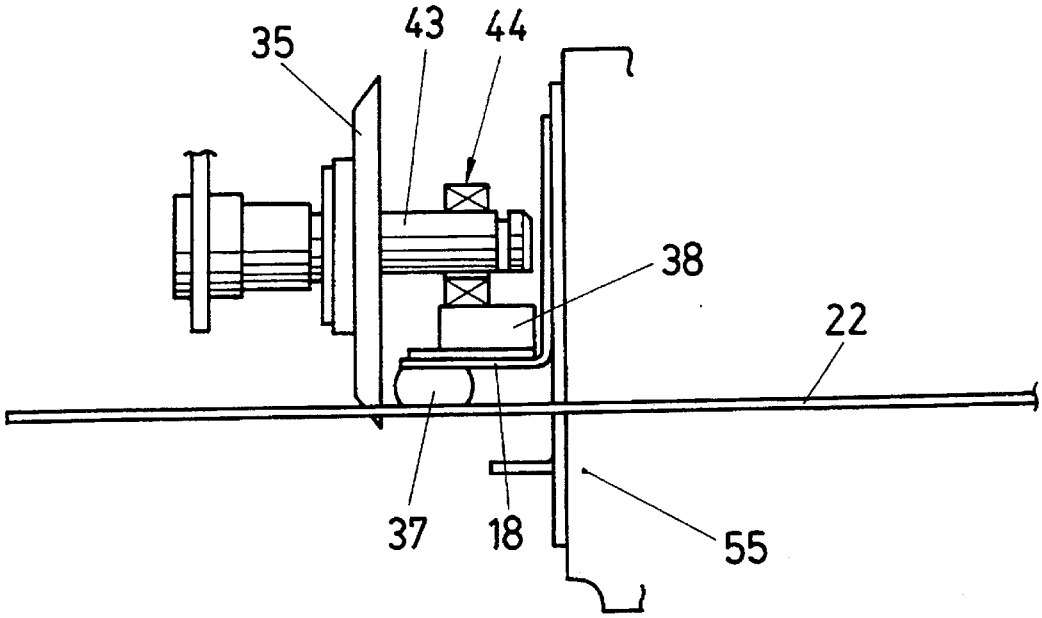
FIG. 18 is a schematic view of the cutting device in FIG. 17 in which the switching mechanism is switched to the pressing operation.
Figure 19:
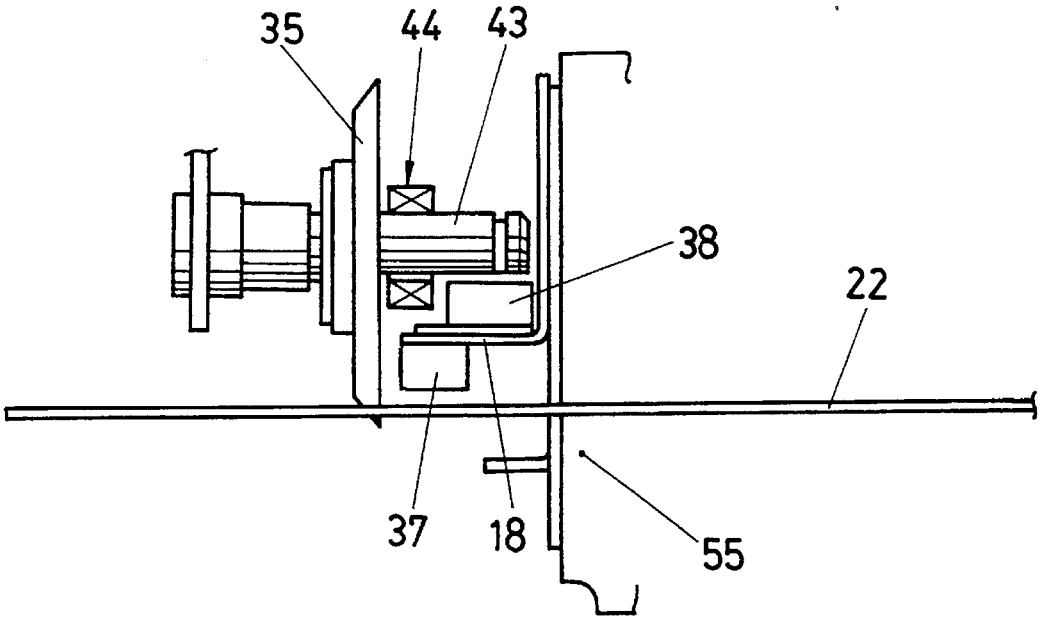
FIG. 19 is a schematic view of the cutting device in FIG. 17 in which the switching mechanism is switched to the canceling the pressing operation.

Fifth Embodiment (FIGS. 17–19)

A cutting device according to a fifth embodiment provided with a switching mechanism capable of releasing the medium from being pressed on by the presser member interlocking with the cutting operation of the disc cutter will be described hereinafter with reference to FIGS. 17 to 19.

Elements in FIGS. 17 to 19 corresponding to those in FIGS. 2A and 2B are denoted at same numerals.

The cutting device according to this embodiment is different from that described with reference to FIGS. 2A and 2B only in comprising a switching mechanism which allows the bearing 44 to be movable to the position where it engages with the presser member interlocking plate 38 and to a position where it does not engage therewith so that the position of the bearing 44 mounted on the shaft 43 which supports the disc cutter 35 can be changed in position along the axial direction of the shaft 43.

That is, the bearing 44 is fit onto the shaft 43 so as to be movable in the axial direction thereof indicated by an arrow K, and a through hole 43*a* is formed diametrically in the shaft 43 and a ball plunger 73 is inserted into the through hole 43*a* to be fitted therein, wherein a ball 73*a* at the tip end of the ball plunger 73 is always forced to project from the outer circumference of the shaft 43 by a spring, not shown, as illustrated in FIG. 17.

A stop ring 72 is fitted in an annular groove formed around the tip end portion of the shaft 43 to position the bearing 44 as illustrated by a solid line in contact with or at a position close to the right side of the ball 73*a* of the ball plunger 73 in the figure.

Moreover, a stop ring 74 is fitted in an annular groove formed around the shaft 43 for positioning the bearing 44 in contact with or at a position close to the left side of the ball 73*a* after the same moves to a position illustrated by a chain line in FIG. 17 pressing down the ball 73*a* of the ball plunger 73 when the bearing 44 is moved to the left from a position illustrated in a solid line in the figure.

As described above, if the bearing 44 is movable along the axis of the shaft 43 between the position illustrated by a solid line in FIG. 17 where it engages with the presser member interlocking plate 38 to press down the same as illustrated in FIG. 18 and the position illustrated by a chain line in FIG. 17 where it does not engage with the presser member interlocking plate 38 as illustrated in FIG. 19, it is possible to let the presser member 37 to press down the medium 22 at a position close to the cutting position being interlocked with the cutting operation of the medium by way of the disc cutter 35 or to cancel the interlocking operation by selecting either of the positions of the bearing 44 set forth above.

Sixth Embodiment (FIGS. 20A, 20B 21A, 21B and 21C)

A cutting device according to a sixth embodiment of the invention provided with an inclination restricting member for restricting the inclination of the presser member relative to the medium will be described hereinafter with reference to FIGS. 20A, 20B, 21A, 21B and 21C.

Figure 20A:
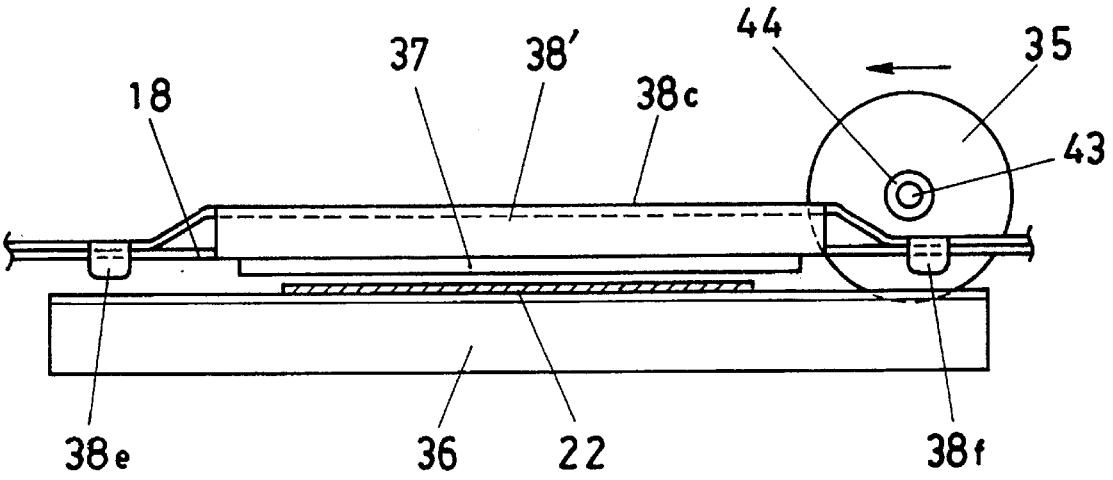
FIGS. 20A and 20B are front views of a cutting device according to a sixth embodiment of the invention in which a presser member interlocking plate is equipped with an inclination control member for controlling the inclination of the presser member.
Figure 20B:
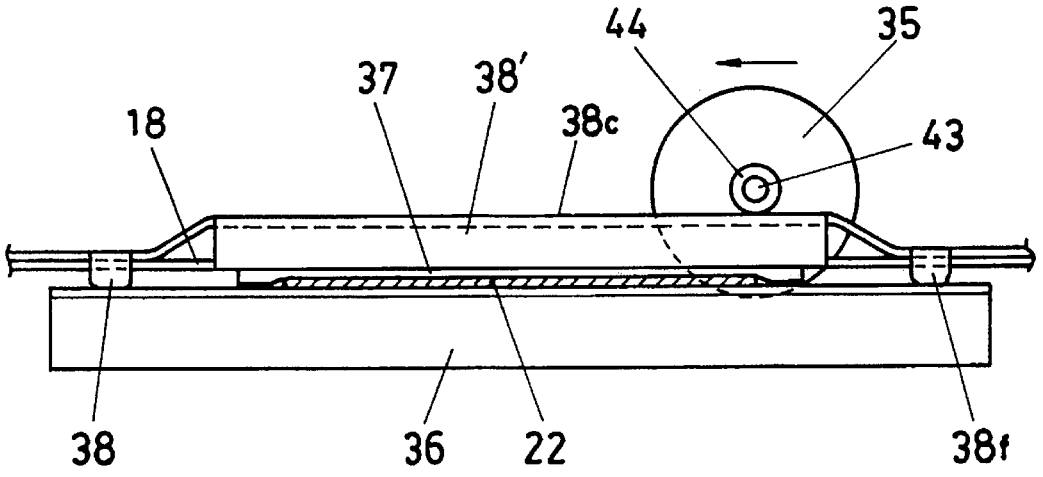

The cutting device is different from that described with reference to FIGS. 1A, 1B, 2A and 2B in that a presser member interlocking plate 38' that is a presser member interlocking member illustrated in FIGS. 20A and 20B is provided with inclination restricting members 38*e* and 38*f* for restricting the inclination of the presser member 37 relative to the medium 22 pressed on by the presser member 37 which has been moved to the fixing position as illustrated in FIG. 20B.

There is a possibility of failure in stably cutting the medium 22 straight when the presser member interlocking plate 38' is not equipped with the inclination restricting members 38*e* and 38*f* since the medium 22 can hardly be pressed on by the presser member 37 uniformly along the cutting direction all over the width thereof when the disc cutter 35 cuts the medium 22.

The process will be described hereinafter with reference to FIGS. 21A, 21B and 21C.

Figure 21A:
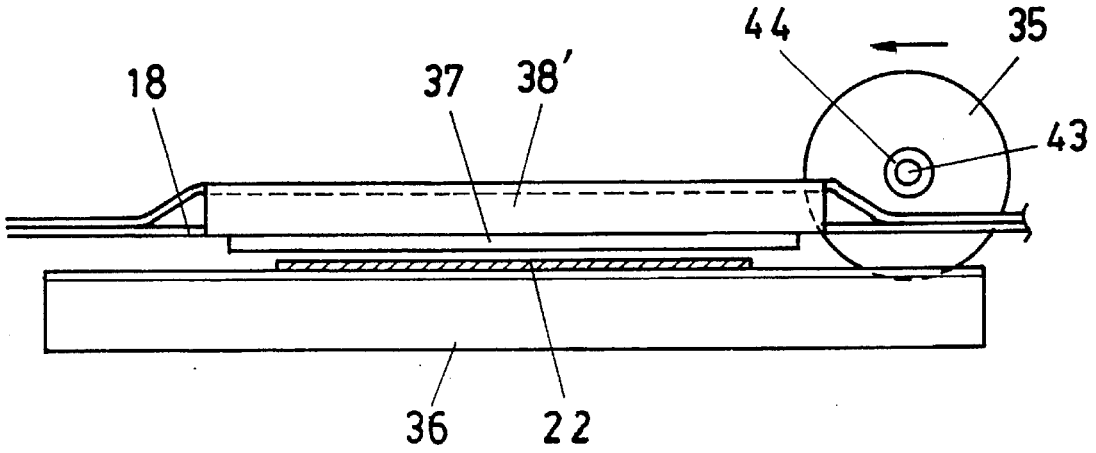
FIGS. 21A, 21B and 21C are the front views of the cutting device in FIGS. 20A and 20B for explaining that without the inclination control member the presser member fails to uniformly press on a wide range of the medium along the cutting direction at the time of cutting the medium.

FIG. 21A shows the cutting device wherein the presser member 37 is at a standby position. When the presser member 37 is at this position, printing is performed on the medium 22 and the medium 22 is fed.

Figure 21B:
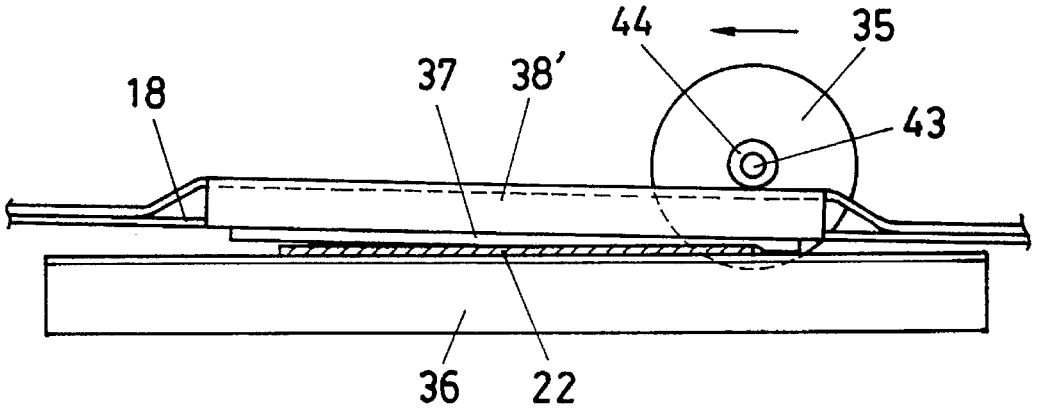
Figure 21C:
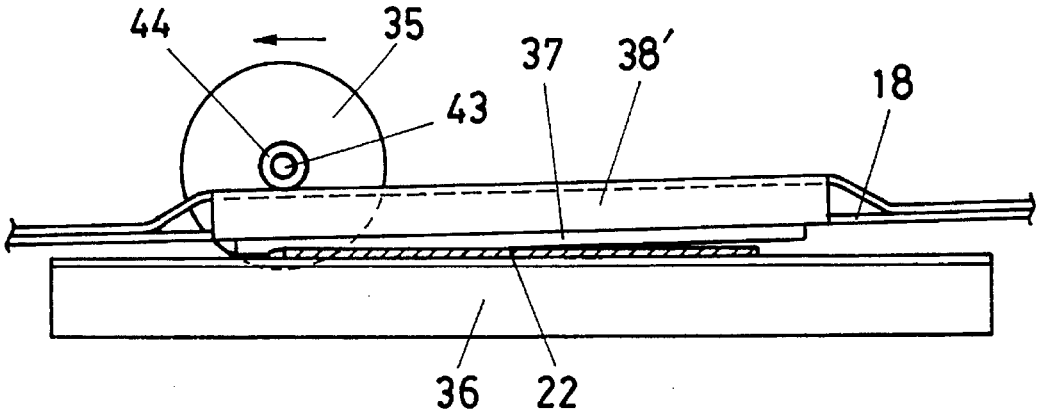

Then cutting operation proceeds to FIG. 21B and then to FIG. 21C. At that time as illustrated in FIG. 21B, as the disc cutter 35 travels from right to left in the figure, the presser member 37 is in close contact with the right end portion of the medium 22 but is in incomplete contact with the left end portion thereof at the early stage of cutting illustrated in the figure.

On the contrary as illustrated in FIG. 21C, the presser member 37 is in close contact with the left end portion of the medium 22 but is in incomplete contact with the right end portion thereof at the stage just before the completion of cutting the medium 22.

As described above, if the presser member interlocking plate 38' is not equipped with the inclination restricting members 38*e* and 38*f*, the presser member 37 is liable to be inclined relative to the medium 22 both at the early stage and the stage just before the completion of cutting when the disc cutter 35 cuts the medium 22 which is pressed on to be fixed at the cutting position by the presser member 37.

When the presser member 37 is inclined, the medium 22 is not uniformly pressed on by the presser member 37 along the cutting direction all over the width thereof and consequently the medium 22 is fixed on the fixed cutter 36 incompletely, so that the medium 22 is liable to be cut along a line deviated from a straight line.

However, since the presser member interlocking plate 38' in the cutting device according to this embodiment is equipped with the inclination restricting members 38*e* and 38*f* for restricting the inclination of the presser member 37 relative to the medium 22 as illustrated in FIGS. 20A and 20B, the medium 22 can be almost uniformly pressed on all over the width thereof by the presser member 37 on the fixed cutter 36, it is possible to cut the medium 22 along a line excellent in linearity.

That is, when the disc cutter 35 moves from the position illustrated in FIG. 20A to the left in the figure to start cutting operation, the bearing 44 is brought into contact with the stage 38*c* of the presser member interlocking plate 38' to press down the same as illustrated in FIG. 20B.

As a result, the presser member 37 which moves vertically together with the presser member interlocking plate 38' integrally therewith moves to the position where it presses on the medium 22 to fix the same on the fixed cutter 36 as illustrated in the figure.

At that time, when the presser member interlocking plate 38' is pressed down, it is stopped at the position where the inclination restricting members 38*e* and 38*f* formed on both end portions of the presser member interlocking plate 38' are in contact with the upper surface of the fixed cutter 36 as illustrated in FIG. 20B, so that the surface of the presser member 37 which is in contact with the medium 22 becomes parallel to the upper surface of the medium 22.

As a result, the medium 22 can be almost uniformly pressed all over the width thereof, on the fixed cutter 36 so that it is possible to cut the medium 22 along a line which is excellent in linearity.

The inclination restricting members 38*e* and 38*f* formed on both sides of the presser member interlocking plate 38' are identical to each other in shape and size and have such a positional relationship therebetween so that the presser member 37 can almost uniformly press all over the width thereof along the cutting direction on the medium 22 on the fixed cutter 36 when the presser member interlocking plate 38' is pressed down by the bearing 44 during the cutting operation of the medium 22.

Figure 22:
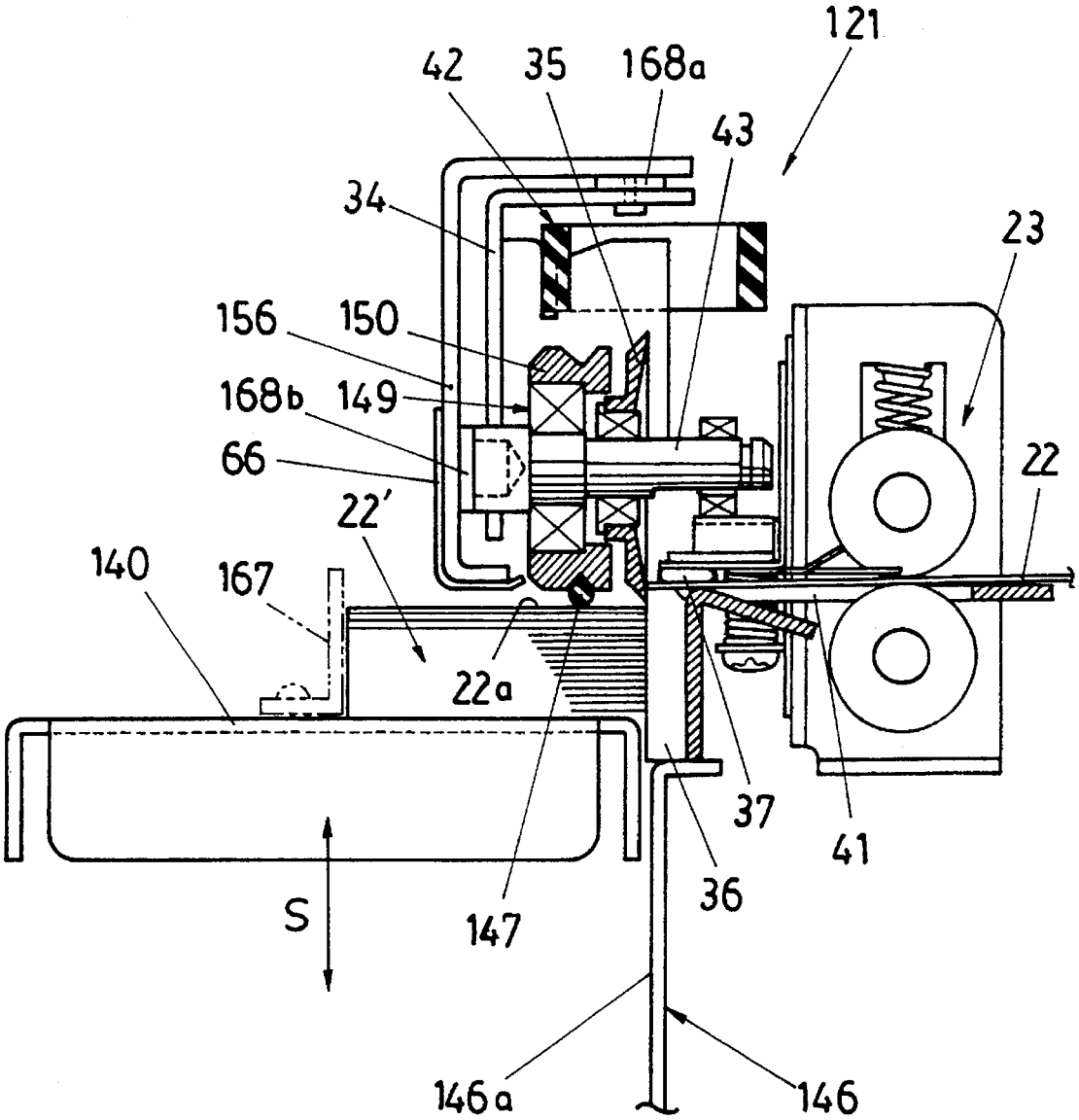
FIG. 22 is a side view of a cutting device according to a seventh embodiment of the invention provided with a medium displacement restricting member for preventing the displacement of the medium by pressing on the surface of the medium and a stack tray which goes away from the medium displacement restricting member in accordance with the number of cut mediums stacked thereon.
Figure 23:
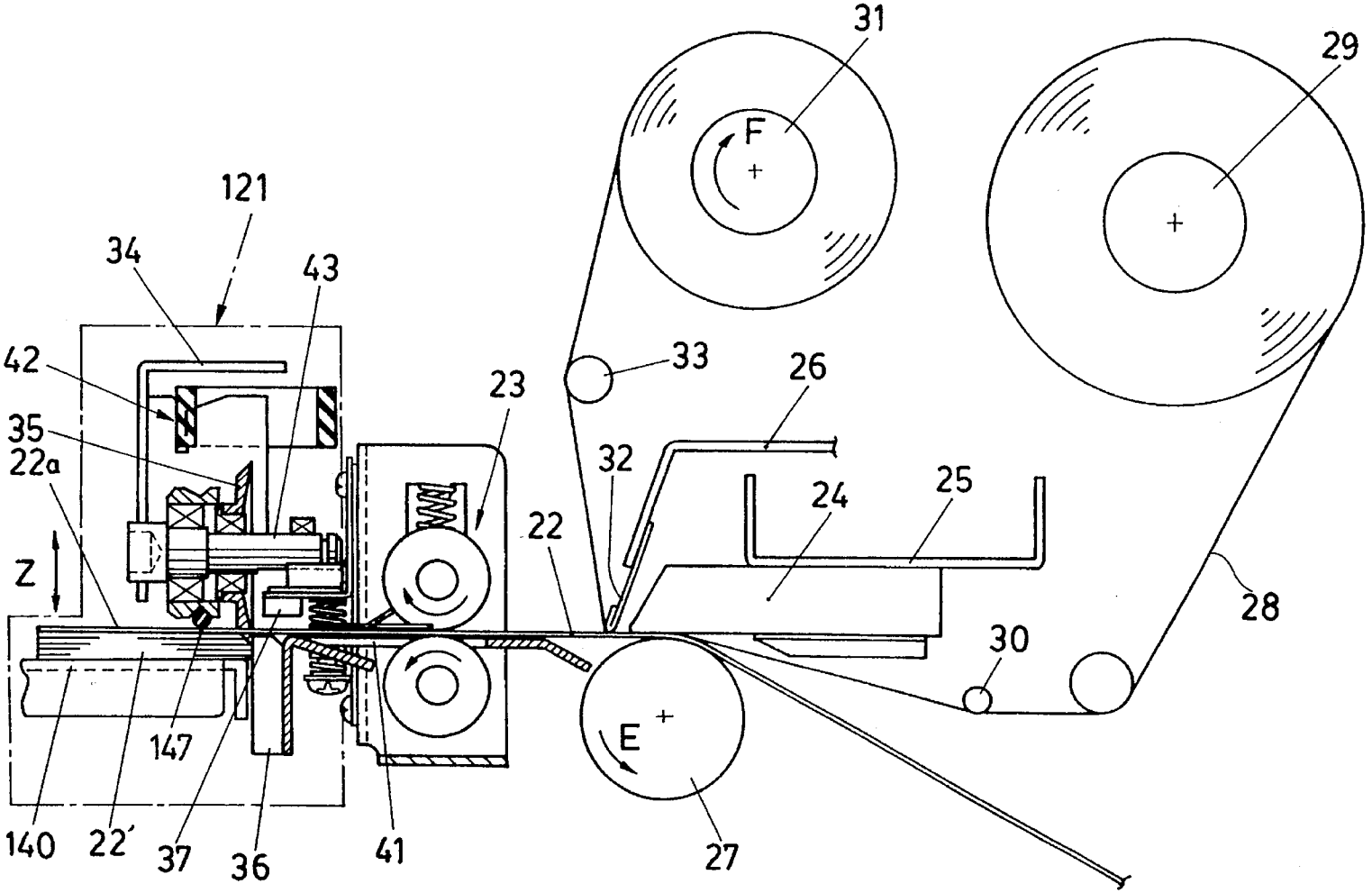
FIG. 23 is a view showing the whole construction of a printing device on which the cutting device in FIG. 22 is mounted.
Figure 24:
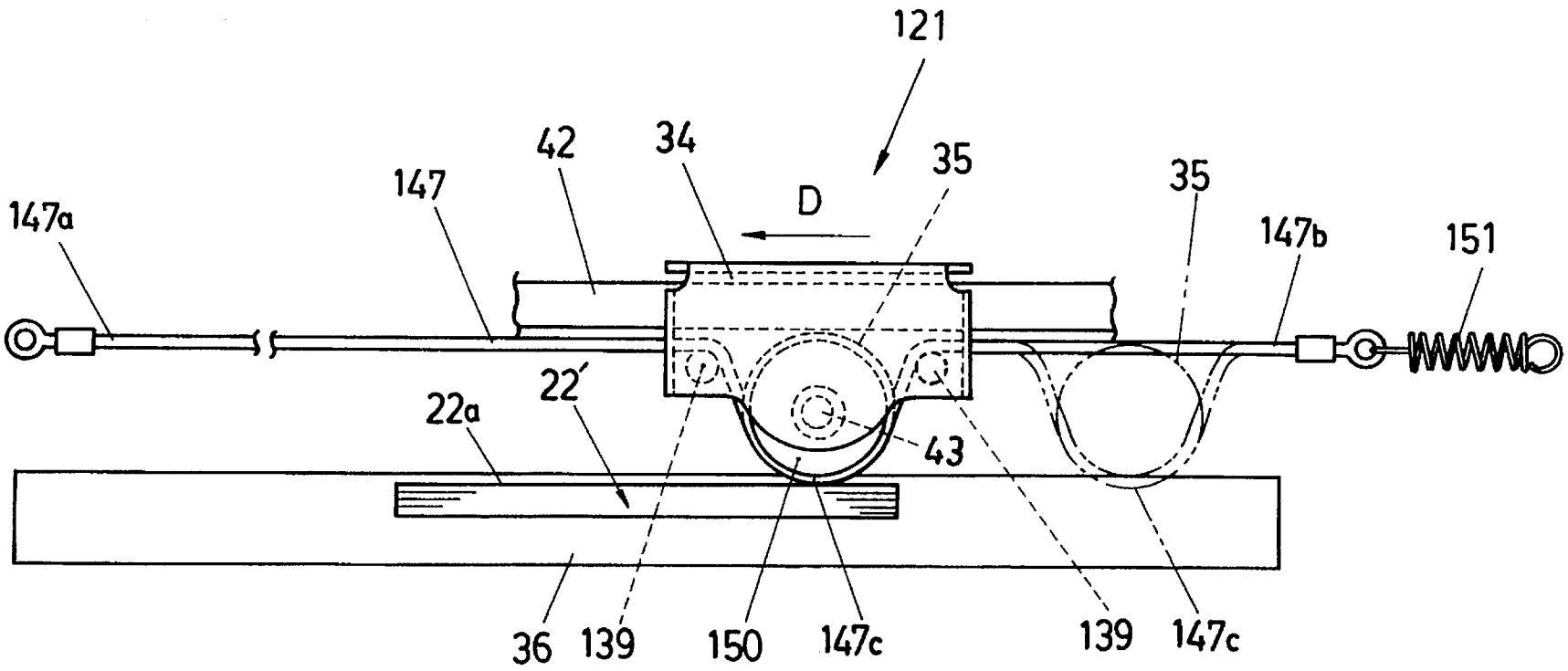
FIG. 24 is a rear side view of the cutting device in FIG. 22.

Seventh Embodiment (FIGS. 22 to 24)

Then a cutting device according to this embodiment wherein the medium cut by the moving and fixed cutters can be successively stacked will be described with reference to FIGS. 22 and 24 and an example of a printing device equipped with the cutting device will be described with reference to FIG. 23 respectively.

Elements in FIG. 22 corresponding to those in FIGS. 2A and 2B and elements in FIG. 23 corresponding to those in FIG. 3 are denoted at the same numerals and the explanation thereof is omitted.

A cutting device 121 according to this embodiment which is, for example, mounted on a printing device illustrated in FIG. 23 cuts a medium 22 such as long paper which is continuous in a shape of belt.

The cutting device 121 comprises a pair of a disc cutter 35 that is a moving cutter similar to those in the embodiments set forth above and a fixed cutter 36 extending in the cutting direction for cutting a medium 22 placed therebetween by moving a carriage 34 along a cutter frame 156 by way of sliding members 168*a* and 168*b* so as to move the disc cutter 35 along the edge which extends in the cutting direction at the upper end of the left surface of the fixed cutter 36 illustrated in FIGS. 22 and 24 while pressing the disc cutter 35 on the fixed cutter 36 by way of a spring etc.

The cutting device 121 is provided with the presser member 37 for pressing on the medium 22 to fix the same at a position close to the cutting position of the disc cutter 35 and fixed cutter 36 so as to cut off a piece of a predetermined length from the medium 22 along a straight and neat line after printing is performed thereon even if the medium 22 is a medium such as thin paper, cloth label etc. which is comparatively low in rigidity in the outward direction of the surface which is perpendicular to the surface 22*a* of the medium 22 indicated by an arrow Z in FIG. 23.

The presser member 37 presses on the medium 22 to fix the same at a position close to the cutting position about the upper surface of the fixed cutter 36 in FIG. 23 also in this embodiment.

The printing device illustrated in FIG. 23 cuts off a piece of a predetermined length from the medium 22 one after another by way of a moving disc cutter 35 and a fixed cutter 36 fixed to the cutting device by alternately moving the carriage 34 which rotatably holds the disc cutter 35 of the cutting device 121 by way of the shaft 43 in the face-to-back and back-to-face directions in the figure similarly to the printing device described with reference to FIG. 3.

The cut medium 22' is successively stacked on one another on a stack tray 140.

The stack tray 140 which is provided just behind the fixed cutter 36 as illustrated in FIG. 22 is mounted on a fixed portion 146, of which only a stack reference surface 146*a* thereof is shown in the figure, by way of holding brackets 104*a* and 104*b* (which will be described later with reference to FIG. 25), described later, so as to be movable only in the direction indicated by an arrow S, the holding brackets 104*a* and 104*b* vertically sliding on the stack reference surface 146*a* with a given friction.

The cutting device 121 also comprises a medium displacement restricting belt 147 that is a medium displacement restricting member provided downstream the cutting position of the disc cutter 35 and fixed cutter 36 with regard to the feeding direction of the medium 22 and movable to a position where it restricts the displacement of the medium 22 in the inner-surface direction of the surface 22*a* of the medium 22 by pressing thereon and to a standby position where it is retracted from the surface 22*a*.

The cutting device 121 successively place the medium 22 on one another to be stacked on the stack tray 140 which lowers in accordance to the number of the cut mediums 22 so as to gradually go away from the medium displacement restricting belt 147, the medium 22 being pressed on by the medium displacement restricting belt 147 after having been cut by the disc cutter 35 and fixed cutter 36.

The medium displacement restricting belt 147 is stretched forming a loop along a part of the periphery of a pulley 150 rotatably attached to the shaft 43 by way of a beating 149, the shaft 43 rotatably supporting the disc cutter 35 by way of a beating as illustrated in FIG. 24.

The medium displacement restricting belt 147 is looped over pulleys 139 and 139 which are rotatably fixed to the carriage 34 to be symmetrical with each other leaving a space therebetween, one end 147*a* of the medium displacement restricting belt 147 being fixed to the fixed portion of the cutting device by way of a fitting and the other end 147*b* thereof being similarly fixed to the fixed portion of the cutting device by way of a fitting and a tension coil spring 151 arranged in series.

The medium displacement restricting belt 147 is an elastic belt formed of either of or a combination of some of silicon rubber, polyurethane, nylon and Aramide fibers. When the disc cutter 35 moves from a standby position illustrated by a chain line in the direction indicated by an arrow D in FIG. 24, the medium displacement restricting belt 147 presses on the surface 22*a*, i.e., the upper surface of the medium 22 in the figure at the lowest portion 147*c* thereof pressed down by the pulley 150 which moves following the disc cutter 35 in the same direction to restrain the displacement of the medium 22.

The medium displacement restricting belt 147 having such elasticity can generate friction necessary for restricting the displacement of the surface 22*a* of the medium 22 after cutting in the left and right direction in FIG. 24 and in the inner-surface direction, e.g., the face-to-back or face-to face direction in the figure while being flexible enough to be successively pushed down from an original line which is in parallel to the fixed cutter 36 to form the lowest portion 147*c* by the disc cutter 35 as the same moves in the direction indicated by an arrow D.

Incidentally, although the disc cutter 35 moves in the direction indicated by the arrow D in FIG. 24, the lowest portion 147*c* of the medium displacement restricting belt 147 is not displaced in the same direction if the displacement due to some expansion and contraction thereof is neglected even if the disc cutter 35 moves while rotating.

As a result, when the medium is successively stacked on one another on the stack tray 140 just after cutting in the cutting device 121 comprising the disc cutter 35 which moves in the cutting direction of the medium, the portion of the medium 22 to be cut is pressed on by the medium displacement restricting belt 147 as illustrated in FIG. 22 although the disc cutter 35 moves in cutting in the direction indicated by the arrow D (the same thing can be the in case of the reverse direction) in FIG. 24, so that the stack of the cut mediums 22' can be prevented from being disturbed since the disc cutter 35 does not flip the same.

When the medium 22 is cut while being pressed on by the medium displacement restricting belt 147 at the surface 22*a* thereof, the disc cutter 35 temporarily stops at a standby position away from the cut medium 22' to the left thereof in FIG. 24 until the medium 22 to be cut next is fed to the cutting position illustrated in FIG. 23.

When the medium 22 reaches the cutting position, the disc cutter 35 moves from left to right in FIG. 24 to resume the cutting operation, so that the surface 22*a* of the medium 22 is pressed down by the lowest portion 147*c* of the medium displacement restricting belt 147 when the medium 22 is cut similarly as the case set forth above.

The disc cutter 35 may return to the home position (the home position may be arbitrarily defined at either of the left and right sides) illustrated by a chain line in FIG. 24 every time it completes cutting the medium 22.

As a piece of a predetermined length is successively cut off from the belt-shaped medium 22 as described above, the cut medium 22' is placed on one another to be stacked on the stack tray 140 being scarcely displaced as illustrated in FIG. 22.

At that time, the stack tray 140 lowers by the thickness of the cut medium 22' every time the same is placed on the stack. As a result, the surface 22*a* of the uppermost cut medium 22' in the stack is kept at a given position relative to the cutting device 121 regardless of the number of cut mediums 22'.

The surface 22*a* of the uppermost cut medium 22' stacked on the stack tray 140 is set to be slightly lower than a feeding path formed by the lower guide plate 41 of the cutting device 121, the upper surface of the fixed cutter 36, etc.

Moreover, the surface 22*a* of the uppermost medium on the stack tray 140 is set to be slightly lower than the feeding path set forth above of the cutting device 121 even when the disc cutter 35 moves to the standby position illustrated by a chain line in FIG. 24 and consequently the medium displacement restricting belt 147 moves to its standby position where it is retracted from the surface 22*a* of the medium 22.

That is, when the medium displacement restricting belt 147 moves to the standby position to release the surface 22*a* of the uppermost medium 22 from being pressed on by the medium displacement restricting belt 147, the absence of pressure among the cut mediums 22' causes the rise of the entire cut mediums 22' in stack, so that the surface 22*a* of the uppermost medium 22 is brought into contact with the lower surface of an L-shaped guide plate 66 which is fixed to the lower end of the cutter frame 156 to be restrained from rising.

At that time too, the surface 22*a* is set to be slightly lower than the feeding path formed by the lower guide plate 41 and the like.

Accordingly, even if the medium 22 to be cut to next is fed onto the uppermost cut medium 22' which has been cut by a predetermined length and stacked on the stack tray 140 to be piled thereon as illustrated in FIG. 22, the succeeding medium 22 is fed onto the stack from a position higher than the uppermost cut medium 22' on the stack tray 140, so that the tip end of the medium 22 does not strike the rear end of the uppermost cut medium 22' to push out the same.

The medium 22 which is fed onto the uppermost cut medium 22' enters under the guide plate 66 to be fed to a predetermined cutting position at the tip end thereof, when the cut medium 22' already stacked thereunder can be displaced by friction to the left in FIG. 22.

A guide plate 167 may be provided on the stack tray 140 to be adjustable in mounting position thereon to prevent such a trouble.

In this way, the cut medium 22' is successively stacked on the stack tray 140 while the same lowers corresponding to the number of the cut mediums 22' in stack until the stack reaches a given height, when a sensor, not shown, provided on the stack reference surface 146*a* of the fixed portion 146 detects it to issue a signal to stop the printing device.

Accordingly, in order to resume printing on the medium 22 to cut off a printed piece therefrom, it is resumed after the cut mediums 22' stacked on the stack tray 140 are taken out.

Although description is made in this embodiment in case of successively placing the cut medium 22' on one another to be stacked on the stack tray 140, the cut medium 22' is successively placed on one another laterally to form a stack lying on one side thereof in a printing device in which the cut medium 22' is fed and discharged in a state wherein the cut medium 22' is erected by 90° from that in this embodiment.

The present invention is also applicable to a cutting device provided in such a printing device.

Figure 25:
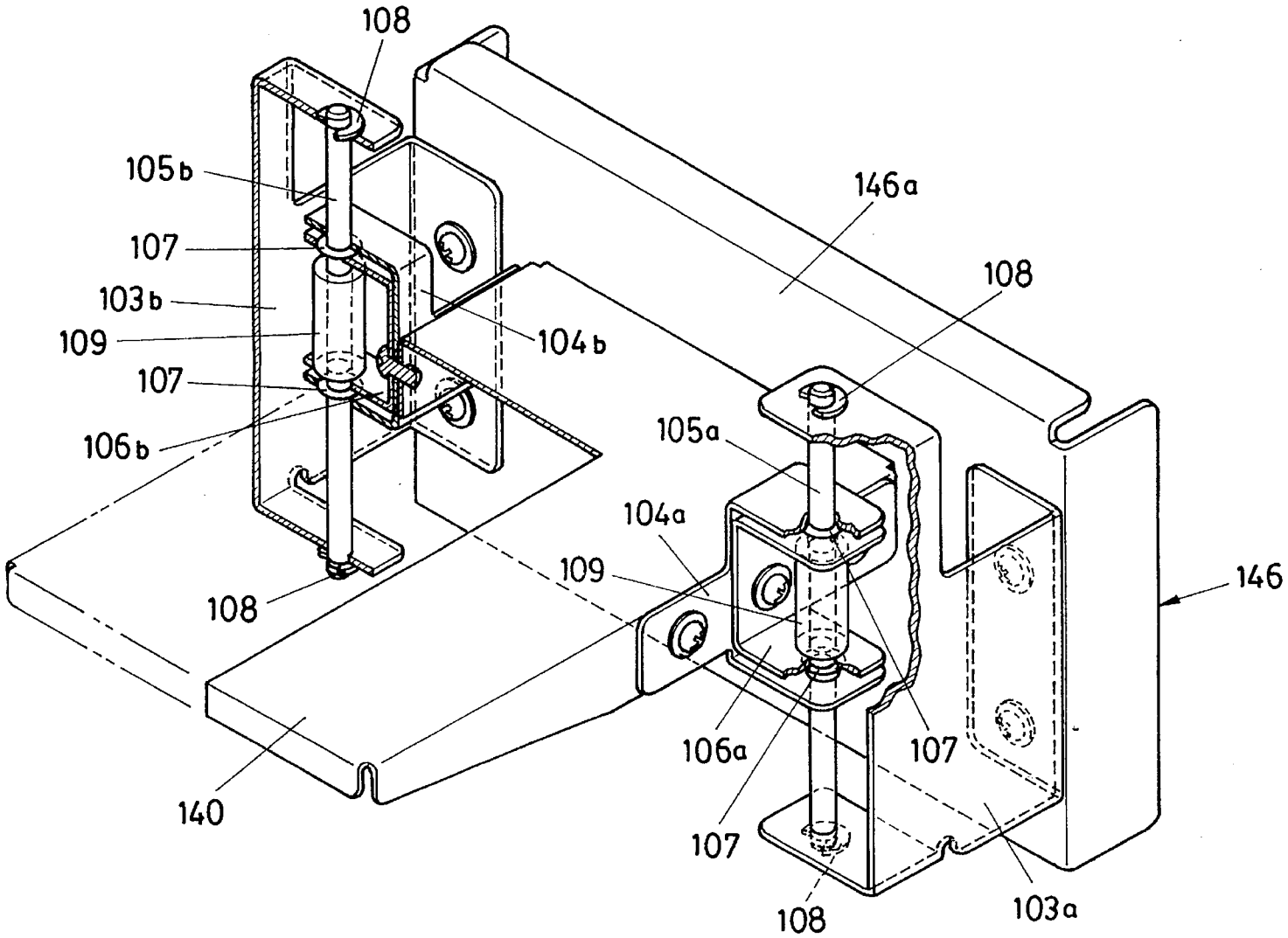
FIG. 25 is a perspective view for explaining a mechanism which hold the stack tray by friction vertically slidably along the fixed portion of the cutting device.

Eighth Embodiment (FIG. 25)

A mechanism for vertically movably holding a stack tray 140 while the stack tray 140 slides frictionally relative to a fixed portion 146 will be described with reference to FIG. 25.

The fixed portion 146 has a stack reference surface 146*a* to which holding members 103*a* and 103*b* are fixed leaving a space therebetween by screws. A slide shaft 105*a* engages in holes defined at upper and lower ends of the holding member 103*a* and come-off stopper E-rings 108 and 108 are mounted around the upper and lower ends of the slide shaft 105*a* while a slide shaft 105*b* engages in holes defined at upper and lower ends of the holding member 103*b* and come-off stopper E-rings 108 and 108 are mounted around the upper and lower ends of the slide shaft 105*b*. Holding brackets 104*a* and 104*b* are fixed to the both sides of the stack tray 140 and supporting brackets 106*a* and 106*b* are fixed to the stack tray 140 by screws outside the holding brackets 104*a* and 104*b* respectively by screws. The holding bracket 104*a* and the supporting bracket 106*a* have respectively holes of the same diameter at the upper and lower surfaces and the slide shaft 105*a* is inserted into these holes to be vertically slidable therein.

O-rings 107 and 107 which engage with the slide shaft 105*a* are positioned at upper and lower small gaps each defined between the holding bracket 104*a* and supporting bracket 106a. A felt 109 impregnated with silicon oil is mounted on the portion of the slide shaft 105*a* which is positioned inside the supporting bracket 106*a*.

Likewise, the O-rings 107 and 107 which engage with the slide shaft 105*b* are positioned at upper and lower small gaps each defined between the holding bracket 104*b* and supporting bracket 106*b*. A felt 109 impregnated with silicon oil is mounted on the portion of the slide shaft 105*b* which is positioned inside the supporting bracket 106*b*.

In such a manner, the stack tray 140 is held by the slide shafts 105*a* and 105*b* by way of the supporting brackets 106*a* and 106*b* and the holding brackets 104*a* and 104*b* due to grip force of the O-rings 107 and 107. The grip force of the O-rings 107 and 107 is set to such a value that the stack tray 140 does not come off even by the weight of the movable portion of the stack tray 140 and the maximum amount of the medium 22 stacked thereon.

Pressing force of a medium displacement restricting belt 147 applied to the medium 22 is set to be greater than the grip force of the O-rings 107 and 107. Accordingly, the stack tray 140 for stacking the medium 22 thereon slides down along the slide shafts 105*a* and 105*b* by the thickness of the medium 22 every time a new medium 22 is stacked on the stack tray 140 due to the pressing force of the medium displacement restricting belt 147 applied to the medium 22.

Silicon oil with which the felt 109 is impregnated functions effectively for stabilizing the grip force of the O-rings 107 and 107 applied to the slide shafts 105*a* and 105*b* and reducing a change of the grip force with the lapse of time.

Figure 26:
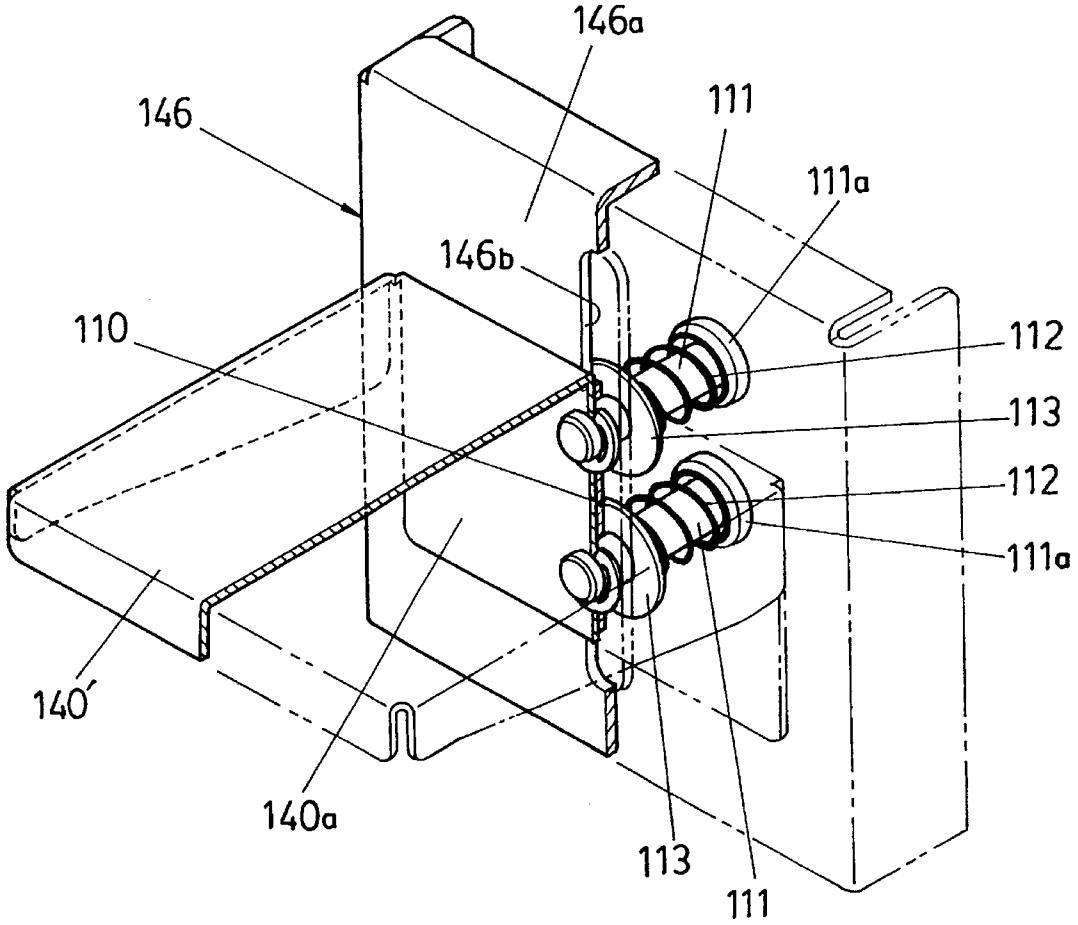
FIG. 26 is a perspective view of a cutting device having a different mechanism for holding the stack tray vertically movably according to a first modification of the seventh embodiment of the invention.

Ninth Embodiment (FIG. 26)

A cutting device according to a ninth embodiment will be described with reference to FIG. 26. FIG. 26 is a perspective view of another mechanism for vertically movably holding a stack tray 140 while the stack tray 140 slides frictionally relative to a fixed portion 146.

The mechanism has a wall surface 140*a* having a large area at the rear end of a stack tray 140' and a felt 110 is stuck to the entire surface of the outside of the wall surface 140a.

Slide pins 111 and 111 are vertically attached to the wall surface 140*a* of the stack tray 140' in a given interval along a vertical line substantially at the central portion of the wall surface 140*a* in the width direction thereof so as to penetrate the wall surface 140*a*.

Each of the slide pins 111 and 111 movably engage in a long hole 146*b* which is vertically formed on the stack reference surface 146*a* of the fixed portion 146.

Slide spacers 113 and 113 are respectively fitted onto the portions of the slide pins 111 and 111 positioned at the rear side of the fixed portion 146 to be movable in the axial direction thereof. Compression coil springs 112 and 112 are interposed between the slide spacers 113 and 113 and the collar portions 111*a* and 111*a* formed at the shaft ends of the slide pins 111 and 111 respectively.

The stack tray 140' is pressed toward the stack reference surface 146*a* since the slide pins 111 and 111 are urged toward the collar portions 111*a* and 111*a* due to resiliency of the compression coil springs 112 so that the felt 110 stuck to the wall surface 140*a* is pressed against the stack reference surface 146*a* of the fixed portion 146.

Accordingly, friction which is generated between the felt 110 and the stack reference surface 146*a* and between the rear side of the stack reference surface 146*a* and the slide spacers 113 serves as a grip force when the stack tray 140' moves vertically along the long hole 146*b*.

The grip force is set to be the same as that of the mechanism as described in the cutting device of the eighth embodiment in FIG. 25.

Tenth Embodiment (FIG. 277)

Figure 27:
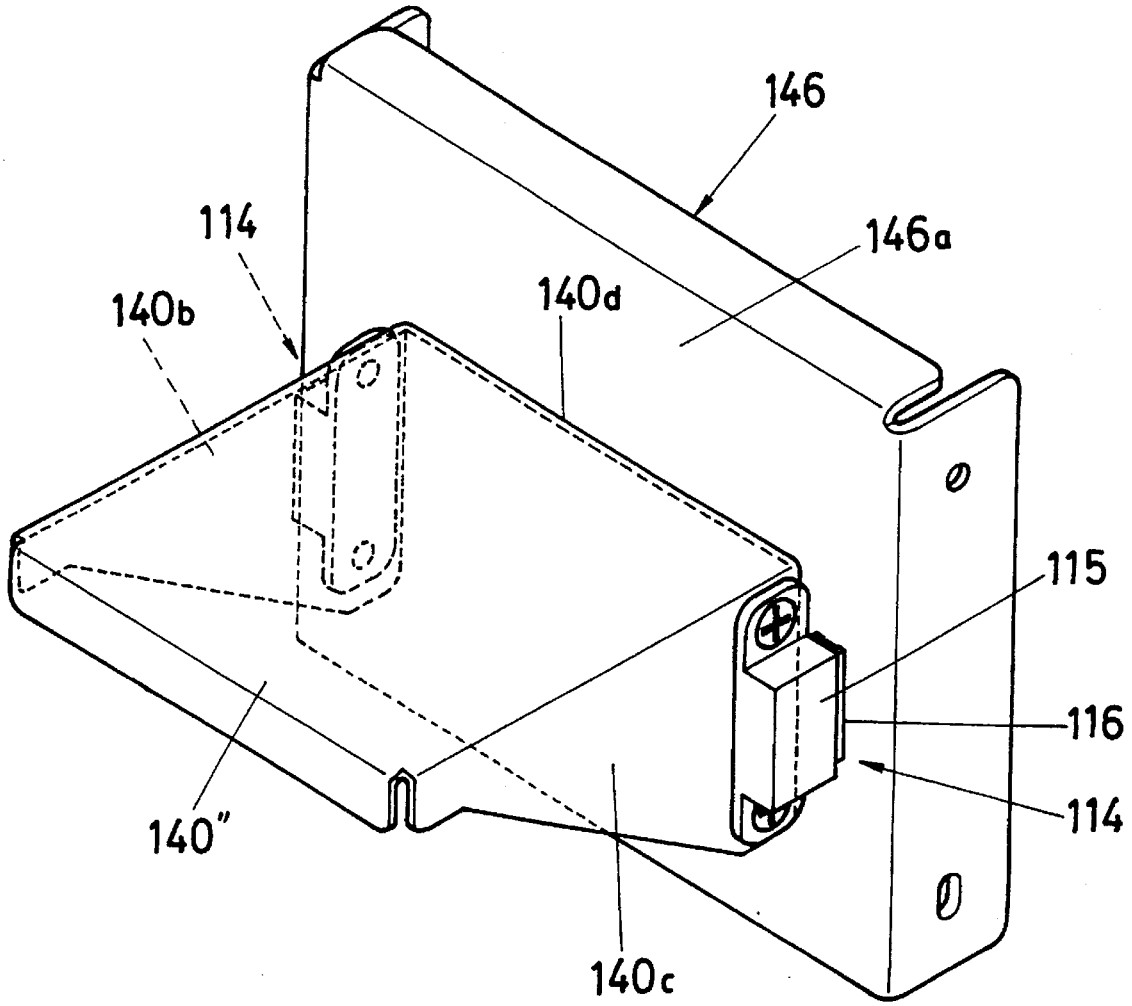
FIG. 27 is a perspective view of a cutting device having another different mechanism for holding the stack tray vertically movably according to a second modification of the seventh embodiment of the invention.

A cutting device according to a tenth embodiment will be described with reference to FIG. 27. FIG. 27 is a perspective view of still another mechanism for vertically movably holding the stack tray which frictionally slides relative to a fixed portion 146.

According to this mechanism, shapes of both side surfaces 140*b* and 140*c* of a stack tray 140" are gradually increased toward the rear ends thereof and magnet units 114 and 114 respectively composed of holders 115 and 115 in which magnets 116 and 116 are accommodated are fixed to the rear end portions of the side surfaces 140*b* and 140*c* respectively by screws.

When each of the magnets 116 and 116 is attracted by the stack reference surface 146*a* of the fixed portion 146 which is formed of a magnetic member such as a steel plate, etc., a rear end edge 140*d* of the stack tray 140" formed in U-shape contacts the stack reference surface 146*a*.

In this mechanism, attractive force applied to the two magnets 116 and 116 by the stack reference surface 146*a* serves as a grip force when the stack tray 140" moves vertically. The grip force of the magnet 116 is set to be equal to that of the mechanism of the cutting device in the eighth and ninth embodiments described with reference to FIGS. 25 and 26.

Figure 28:
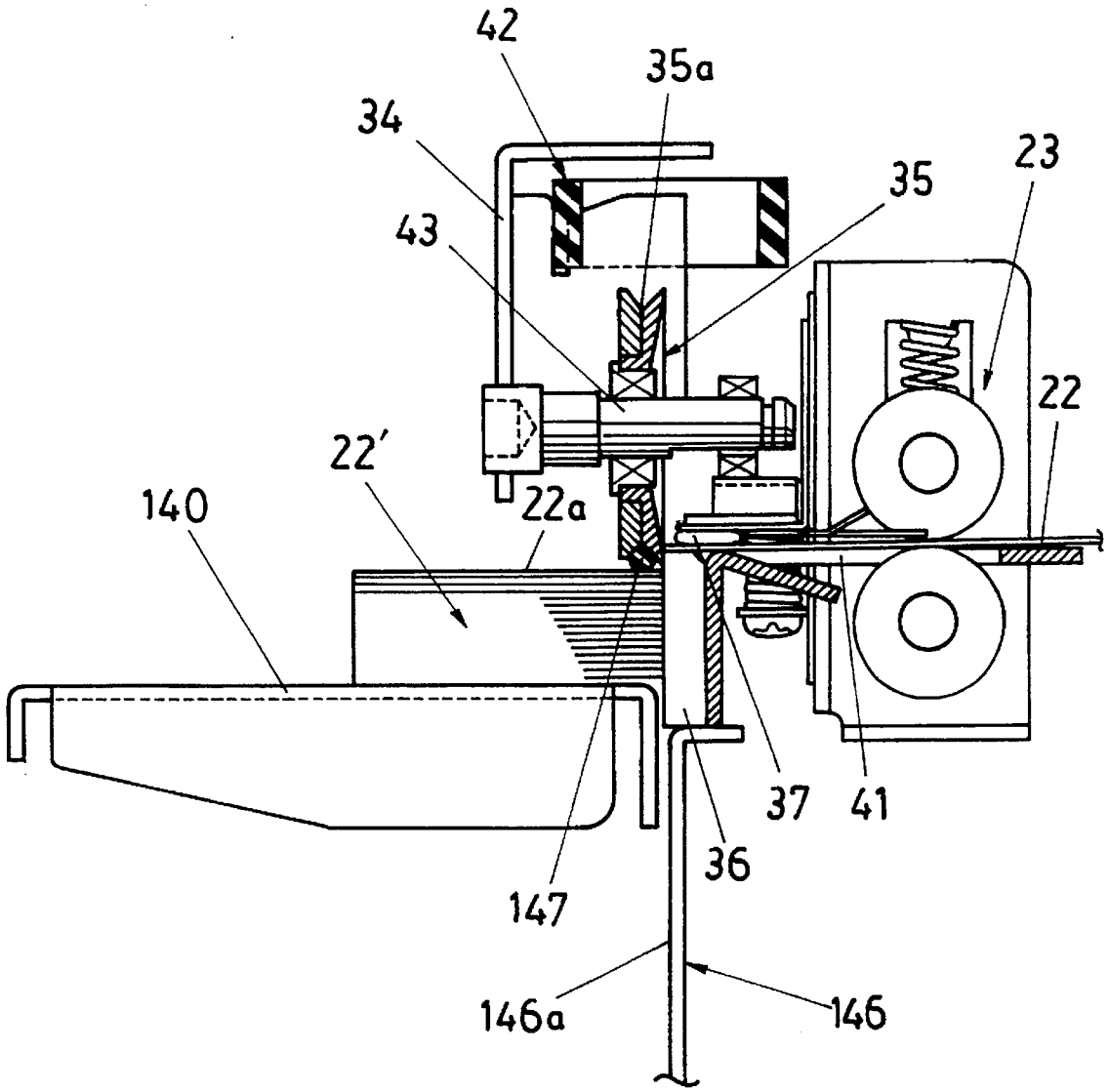
FIG. 28 is a schematic view of a cutting device according to an eighth embodiment of the invention in which a medium displacement restricting belt is directly looped over a V-shaped groove formed on the outer periphery of the disc cutter.

Eleventh Embodiment (FIG. 28)

A cutting device according to an eleventh embodiment will be described with reference to FIG. 28. According to this embodiment, the medium displacement restricting belt directly loops around a V-shaped groove defined in the outer periphery of the disc cutter. Elements corresponding to those of FIG. 22 are denoted at the same numerals.

The cutting device of this embodiment is different from that of the seventh embodiment in FIG. 22 in respect of the provision of a V-shaped groove. That is, the cutting device of this embodiment has the V-shaped groove 35*a* at the outer periphery of the disc cutter 35 and the medium displacement restricting belt 147 directly loops around the V-shaped groove 35*a* without using a dedicated pulley around which the medium displacement restricting belt 147 is entrained as in the seventh embodiment.

With such an arrangement of the V-shaped groove 35*a*, when the disc cutter 35 moves along the tip end of the fixed cutter 36 for cutting operation, a loop of the medium displacement restricting belt 147 formed along the V-shaped groove 35*a* of the disc cutter 35 is forcibly moved in the cutting direction as it is successively pushed down by the disc cutter 35 which moves in the forward direction relative to the cutting direction of the medium 22 while rotating normally relative to the fixed cutter 36.

Accordingly, the disc cutter 35 when cutting the medium 22 scarcely generates force to displace the medium 22 in the inner surface direction of the surface 22*a* of the medium 22, namely, in the face-to-back or back-to face direction in FIG. 28 (it depends on moving direction of the disc cutter 35 for cutting) since it rotates in the forward direction relative to the cutting direction of the medium 22. As a result, the medium 22' after it was cut can be stacked on the stack tray 140 while scarcely getting out of position.

In the eleventh embodiment, the tension coil spring 151 is mounted at the one end of the medium displacement restricting belt 147 to always give a predetermined tension to the medium displacement restricting belt 147 in the same manner as the tension coil spring 151 in the seventh embodiment of FIG. 24, so that the V-shaped groove 35*a* of the disc cutter 35 and the medium displacement restricting belt 147 contact each other with stable friction.

As mentioned above, even if the pulley is not disposed coaxially on the shaft 43 for supporting the disc cutter 35, the cutting device of the eleventh embodiment can obtain a similar effect as that of the seventh embodiment illustrated in FIG. 22 by merely entraining the medium displacement restricting belt 147 around the V-shaped groove 35*a* of the disc cutter 35.

A first modification of the medium displacement restricting belt 147 according to the eleventh embodiment according to the eleventh embodiment will be described with reference to FIG. 29.

Figure 29:
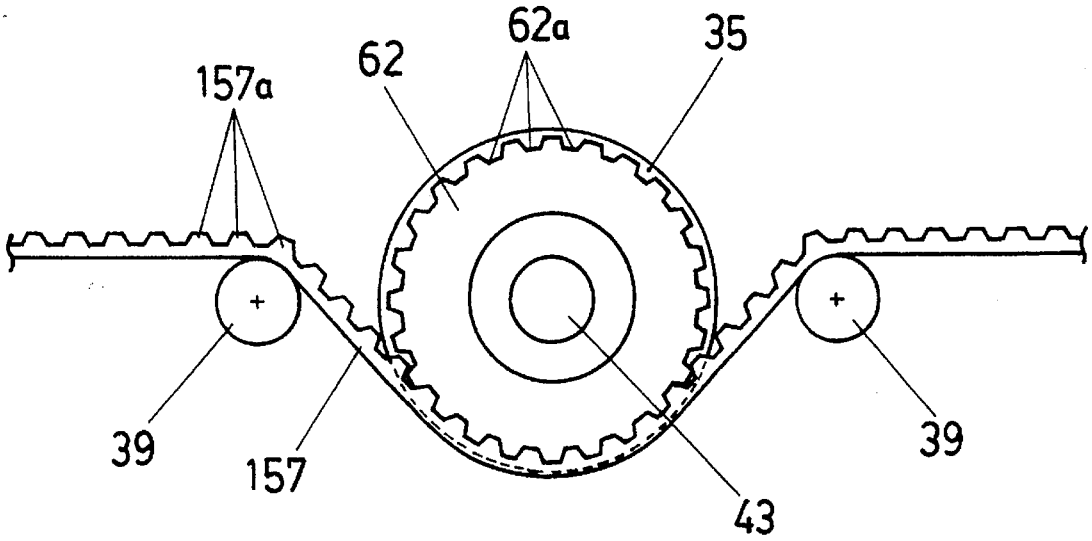
FIG. 29 is a rear view of a cutting device according to the eight embodiment in which the portions of the disc cutter and the medium displacement restricting belt which are in contact with each other have shapes which remarkably reduce relative slippage.

A medium displacement restricting belt 157 is formed of a toothed belt having teeth 157*a* which are formed on the inner surface thereof in equal pitches as illustrated in FIG. 29. The disc cutter 35 serving as the moving cutter has a pulley 62 integrally fixed thereto. The pulley 62 has a groove portion 62*a* which meshes with the teeth 157*a* of the medium displacement restricting belt 157.

In such an arrangement, when the disc cutter 35 moves in the longitudinal direction of the fixed cutter 36, namely, rightward and leftward in FIG. 29, the sliding of the disc cutter 35 relative to the medium displacement restricting belt 157 can be reduced extremely when the disc cutter 35 cuts the medium 22. As a result, the medium 22 cut by the disc cutter 35 moving in the cutting direction scarcely receives force to displace the medium 22 out of position so that the medium 22 can be cut effectively and certainly.

A second modification of the medium displacement restricting belt 147 will be described with reference to FIG. 30.

The medium displacement restricting belt 147 has a helically wound steel wire 155 engaging with the outer periphery thereof so that the helically wound portion thereof in substantially equal pitches forms a helical projection 155*a* on its outer peripheral surface. A pulley 62' having a groove portion 62*a'* which meshes the helical projection 155*a* of the medium displacement restricting belt 147 is integrally fixed to the disc cutter 35.

In this second modification of the medium displacement restricting belt 147, the sliding of the disc cutter 35 relative to the medium displacement restricting belt 157 can be reduced extremely like the first modification in FIG. 29. As a result, it is possible to cut the medium 22 effectively and stack the cut mediums 22' without disturbing the stacking.

Figure 30:
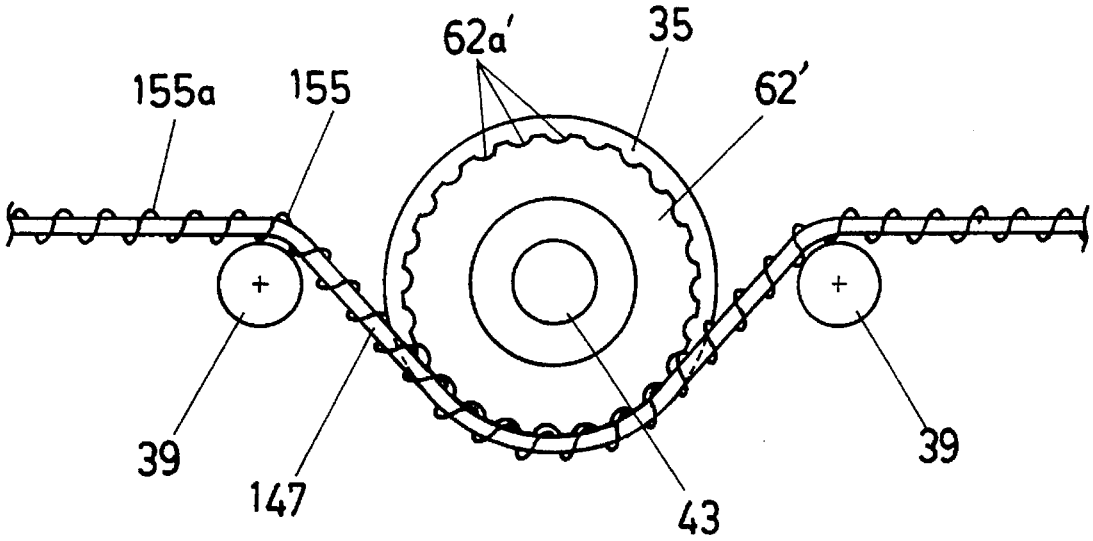
FIG. 30 is a rear view of a cutting device according to a modification of the eight embodiment in which the portions of the disc cutter and the medium displacement restricting belt which are in contact with each other have shapes which remarkably reduce relative slippage.

The medium displacement restricting belts 157 and 147 illustrated in FIGS. 29 and 30 are stretched between the fittings fixed to the fixed portion at both ends thereof with a given tension applied thereto by the tension coil springs 151 each connected to each one end thereof in the same manner as in the seventh embodiment of FIG. 24.

The helical projection 155*a* of the medium displacement restricting belt 147 in the second modification of the eleventh embodiment in FIG. 30 are explained for the case where the helically wound steel wire 155 is separately provided and engages in the medium displacement restricting belt 147 but the medium displacement restricting belt 147 may be formed of a rubber material and the helical projection may be integrally formed on the outer peripheral surface of the medium displacement restricting belt 147.

In the first and second modification as illustrated in FIGS. 29 and 30, the grooves 62*a* and 62*a'* meshing with the teeth 157*a* and the helical projection 155*a* of the medium displacement restricting belt 157 may be formed directly on the outer peripheral portion of the disc cutter 35 where they do not affect the cutting operation of the disc cutter 35.

Figure 31:
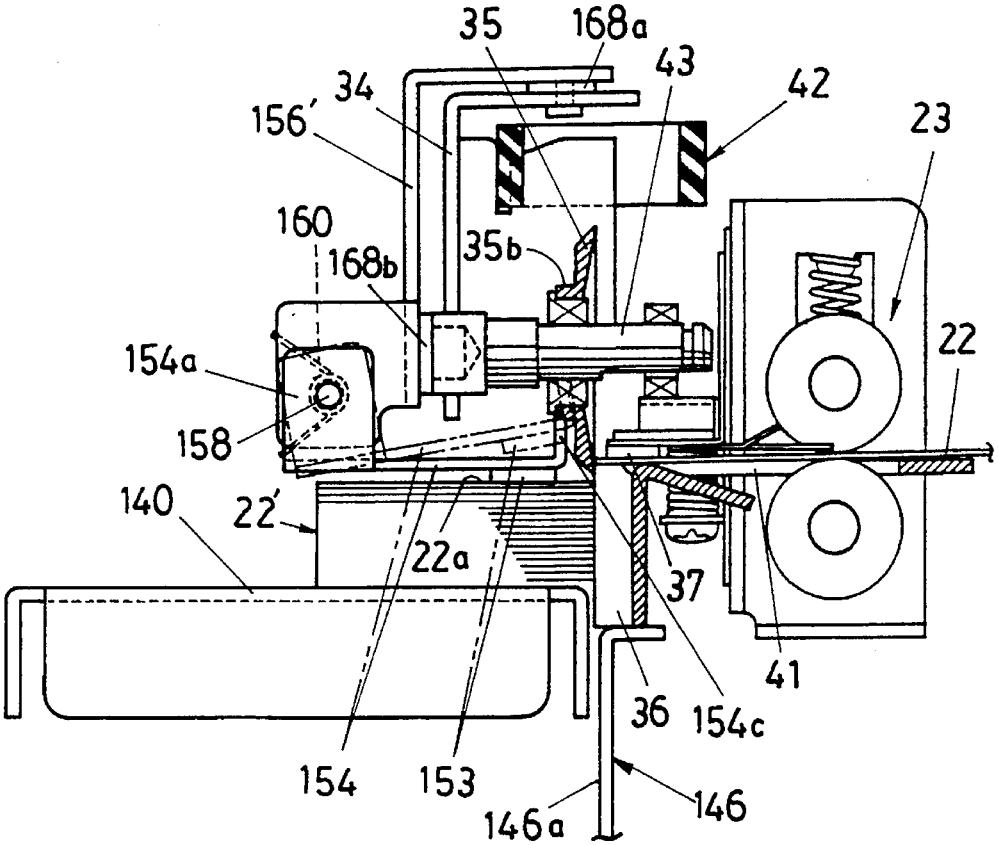
FIG. 31 is a schematic view of a cutting device according to a ninth embodiment of the invention provided with a medium displacement restricting member having a shape different from that illustrated in FIG. 22.
Figure 32:
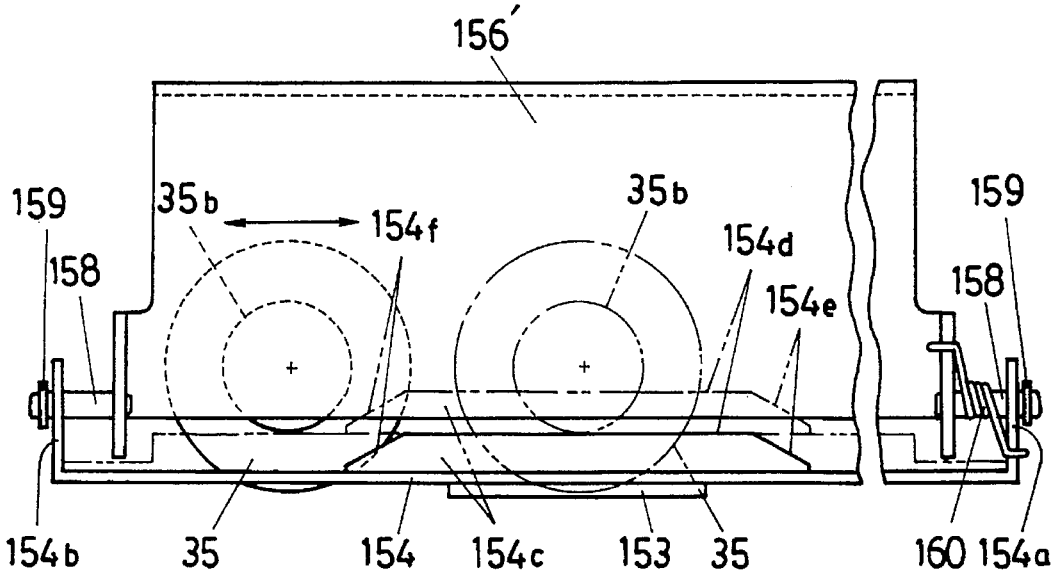
FIG. 32 is a rear view of the cutting device in FIG. 31.

Twelfth Embodiment (FIGS. 31 and 32)

A cutting device according to a twelfth embodiment provided with a further different displacement restricting member will be described with reference to FIGS. 31 and 32. Elements in FIGS. 31 and 32 corresponding to those in FIGS. 22 and 24 are denoted at the same numerals.

A medium displacement restricting member of the cutting device for restricting the medium from getting out of the position by pressing on the surface of the medium is a medium presser member 153 which is formed of a long flexible material and is disposed in parallel with the fixed cutter 36 along the cutting direction of the medium in a given length. The medium presser member 153 is integrally fixed to the lower surface of a substantially central portion of a bracket 154 along the cutting direction of the medium (rightward and leftward in the same figure as illustrated in FIG. 32).

The bracket 154 has supporting surfaces 154*a* and 154*b* (FIG. 32) formed by bending both left and right ends thereof upward substantially perpendicular thereto in FIG. 31. Studs 158 and 158 respectively fixed to both side surfaces of a cutter frame 156' are inserted in attachment holes formed respectively on the supporting surfaces 154*a* and 154*b* and come-off stoppers 159 and 159 are mounted on the studs 158 and 158 so that the bracket 154 can swing to the positions together with the medium presser member 153 as illustrated by a solid line or a chain line in FIG. 31.

A coiled portion of a twist coil spring 160 engages with one stud 158 and one end of the twist coil spring 160 is held by an end edge of the supporting surfaces 154*a* of the bracket 154 and the other end of the twist coil spring 160 is held by an end edge of the cutter frame 156' so that the bracket 154 is swung to a position illustrated by a chain line in FIG. 31 due to resiliency (restoring force) of the twist coil spring 160 until it is brought into contact with a stopper, not shown, to be restrained in its position thereby.

The bracket 154 has a cutting operation interlocking portion 154*c* formed by bending the right end side thereof substantially at right angles upward as illustrated in FIG. 31, the cutting operation interlocking portion 154*c* comprising an engaging end portion 154*d* having a given length and the same height at the central portion thereof in the width direction and inclined portions 154*e* and 154f respectively formed at both sides thereof as illustrated in FIG. 32.

The cutting operation interlocking portion 154*c* serves as a cutting operation interlocking member for swinging the entire bracket 154 from the position illustrated by the chain line to the position illustrated by the solid line in FIG. 31 when the inclined portions 154*e* and 154f and the engaging edge portion 154*d* engage with a lower end side of an engaging outer peripheral portion 35*b* defined at the rear side of the disc cutter 35 during the cutting operation of the disc cutter 35 which moves in the cutting direction. As a result, the medium presser member 153 is moved to a position where the medium 22 is pressed thereby.

When the cutting operation starts, a cutter motor (not shown) is driven to rotate the timing belt 42, whereby the carriage 34 departs from a standby position to move the disc cutter 35 supported thereby in the cutting direction.

As a result, the engaging outer peripheral portion 35*b* at the rear surface of the disc cutter 35 engages with the inclined portion 154*e* of the bracket 154 (in case that the disc cutter 35 moves from the right side to the left side in FIG.

32) to thereby press the inclined portion 154*e* downward so that the bracket 154 swings clockwise about the stud 158 as a whole in FIG. 31 and the medium presser member 153 is pressed downward.

When the engaging outer peripheral portion 35*b* reaches the engaging edge portion 154*d* which is the highest in position in the cutting operation interlocking portion 154*c*, a swing angle of the bracket 154 becomes the maximum so that the medium presser member 153 contacts and presses on the surface 22*a* of the medium 22 to be cut.

Accordingly, since the medium 22 is cut at the state where the surface 22*a* of the medium 22 is pressed on by the medium presser member 153, the cut medium 22' is not liable to be disturbed on the stack tray 140 in the same manner as each of the previous embodiments even if the cut medium 22' is stacked on the stack tray 140 immediately after it is cut.

In this twelfth embodiment like the seventh embodiment in FIG. 22, the guide plate 66 as shown in FIG. 22 is fixed to the lower end of the cutter frame 156' so that the height of the surface 22*a* of the uppermost cut medium 22' is set to be slightly lower than the height of the medium 22 which is fed successively to the cutting device 21 and an opening is defined on the bracket 154 to prevent the same from interfering with the guide plate 66 so that the lower end of the guide plate 66 can contact the upper surface of the cut medium 22' through the opening of the bracket 154 although the guide plate 66 is omitted to be shown in FIG. 31.

Accordingly, there is no likelihood that the rear end of the cut medium 22' which has been already stacked on the stack tray 140 is pushed by a tip end of the medium 22 which is to be fed on the cut medium 22' for next cutting operation to thereby disturb the stacking position of the cut medium 22'.

It is effective if the medium presser member 153 is formed of any one or a combination of materials such as silicon rubber, polyurethane, nylon and Aramide fibers.

If the medium presser member 153 is formed of the aforementioned material, it is possible to generate friction necessary for restricting the cut medium 22' from getting out of position in the inner surface direction of the surface 22*a* by pressing on the surface 22*a* of the medium 22, and it is also possible to restrict the medium 22 (22') from getting out of the position in the inner-surface direction of the surface 22*a* without leaving unnecessary contamination on the medium 22 (22') even if the medium presser member 153 contacts the medium 22 (22').

In this twelfth embodiment too, since the medium presser member 153 is pressed down to the position as illustrated by a solid line in FIG. 31 by way of the bracket 154 at the time of cutting operation and the stack tray 140 is lowered according to the number of the cut mediums 22' stacked thereon, the surface 22*a* of the cut medium 22 which is placed at the highest position of those stacked on the stack tray 140 is held at a constant height.

It is possible to vary a mechanism for moving the medium presser member 153 to the position where the medium 22 is pressed being interlocked with the cutting operation.

Figure 33:
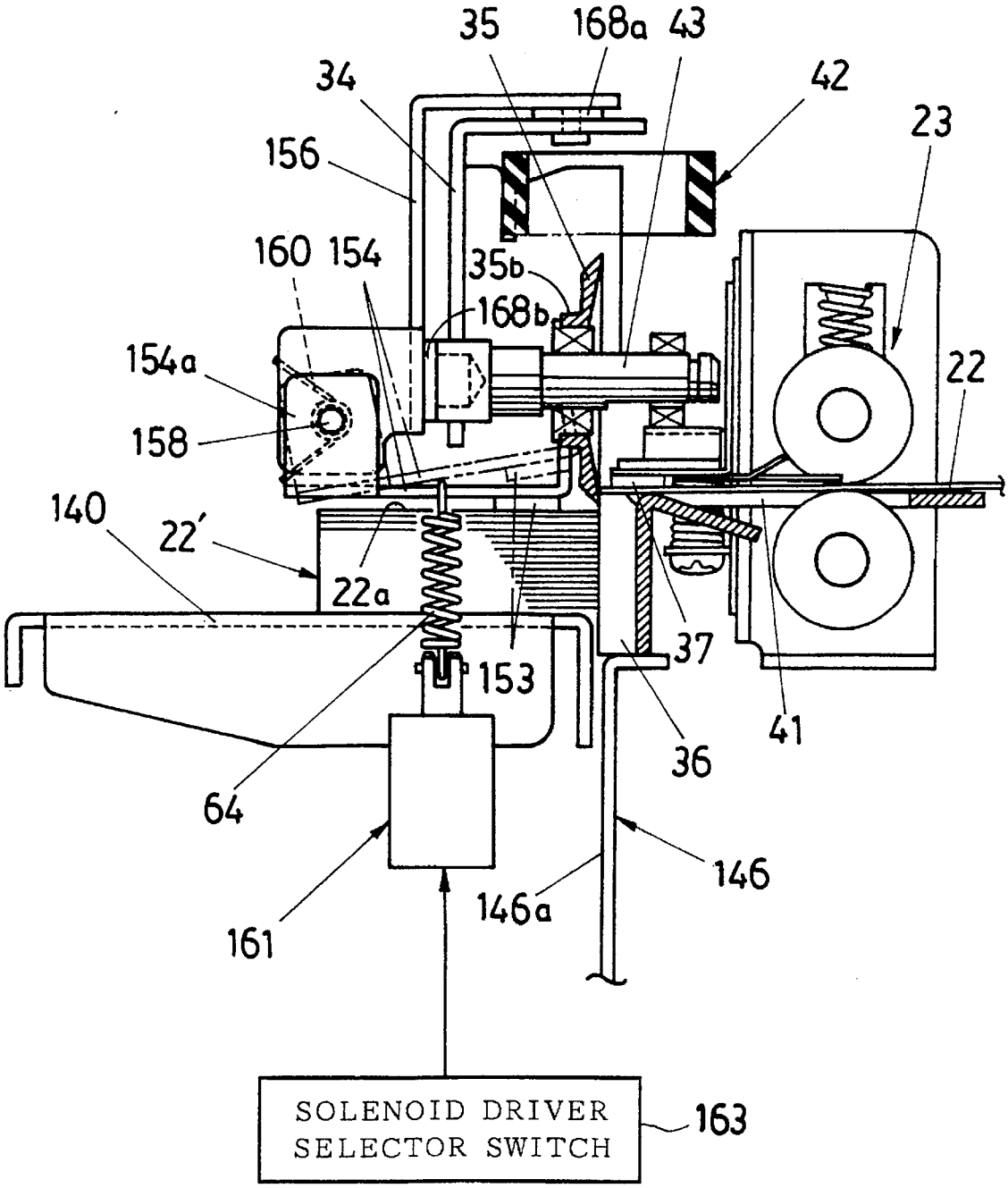
FIG. 33 is a schematic view of a cutting device according to a tenth embodiment of the invention provided with an actuator which can arbitrarily move the medium displacement restricting member to a position where the same presses on the surface of the medium.
Figure 34:
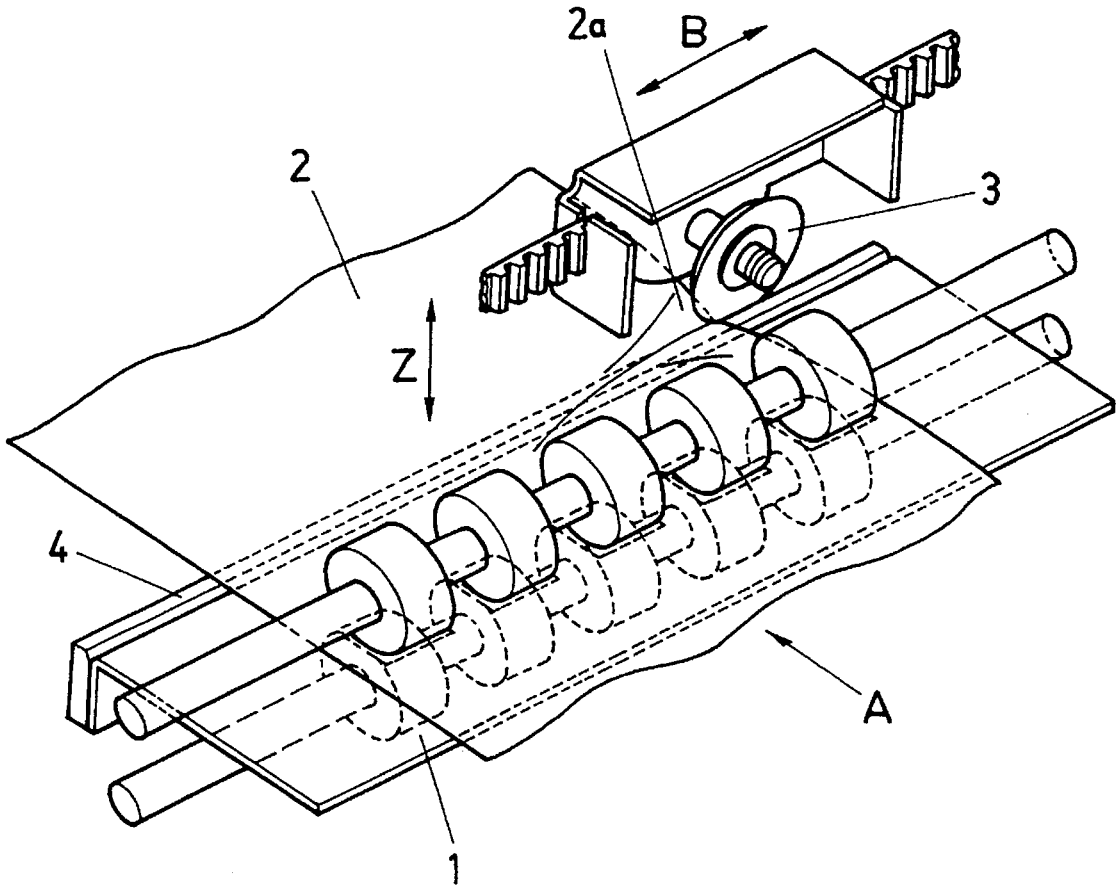
FIG 34 PRIOR ART
FIG. 34 is a perspective view of a conventional cutting device which cuts the medium with a moving disc cutter and a fixed cutter.
Figure 35B:
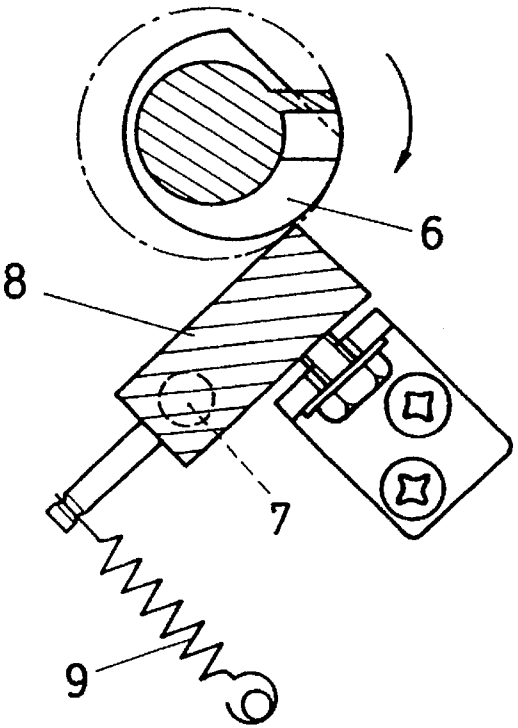
FIG. 35B PRIOR ART
FIGS. 35A and 35B are a front and a longitudinally cross-sectional view of a conventional cutting device comprising a disc cutter and a fixed cutter which is swingably supported by the device and pressed on the disc cutter for cutting a medium inserted therebetween.
Figure 35A:
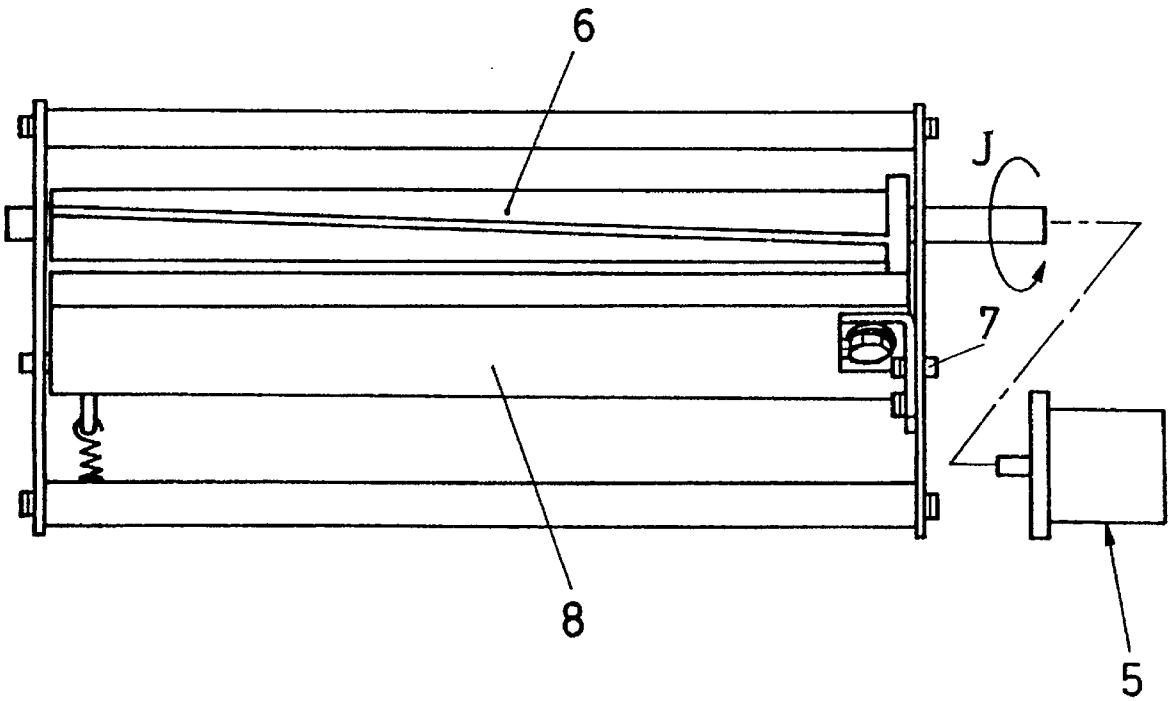
FIG. 35A PRIOR ART
Figure 36:
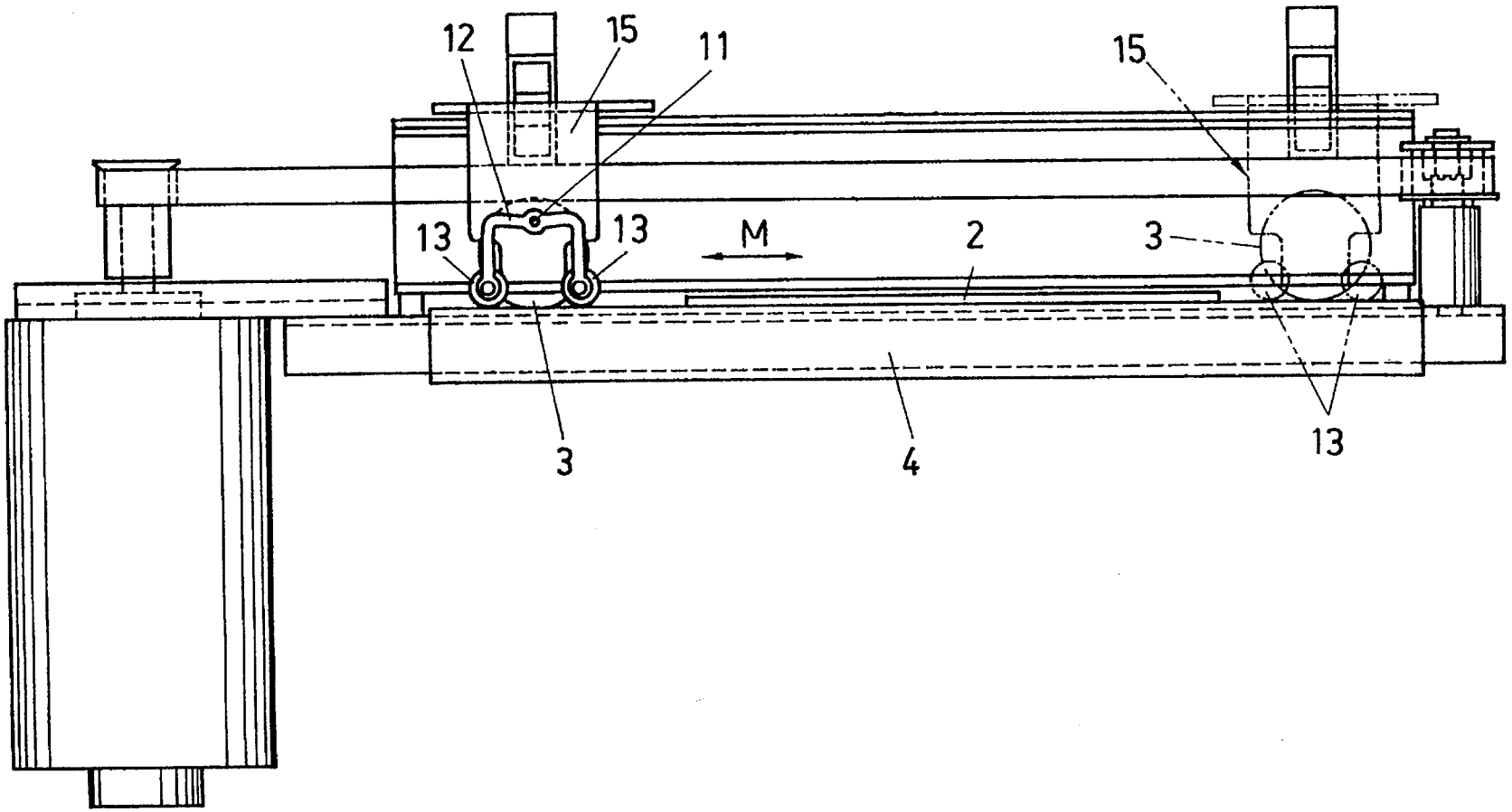
FIG. 36 PRIOR ART
FIG. 36 is a front view of a conventional cutting device provided with presser rollers 13 and 13 to keep the medium in position when the same is cut by way of a moving disc cutter and a fixed cutter.
Figure 37:
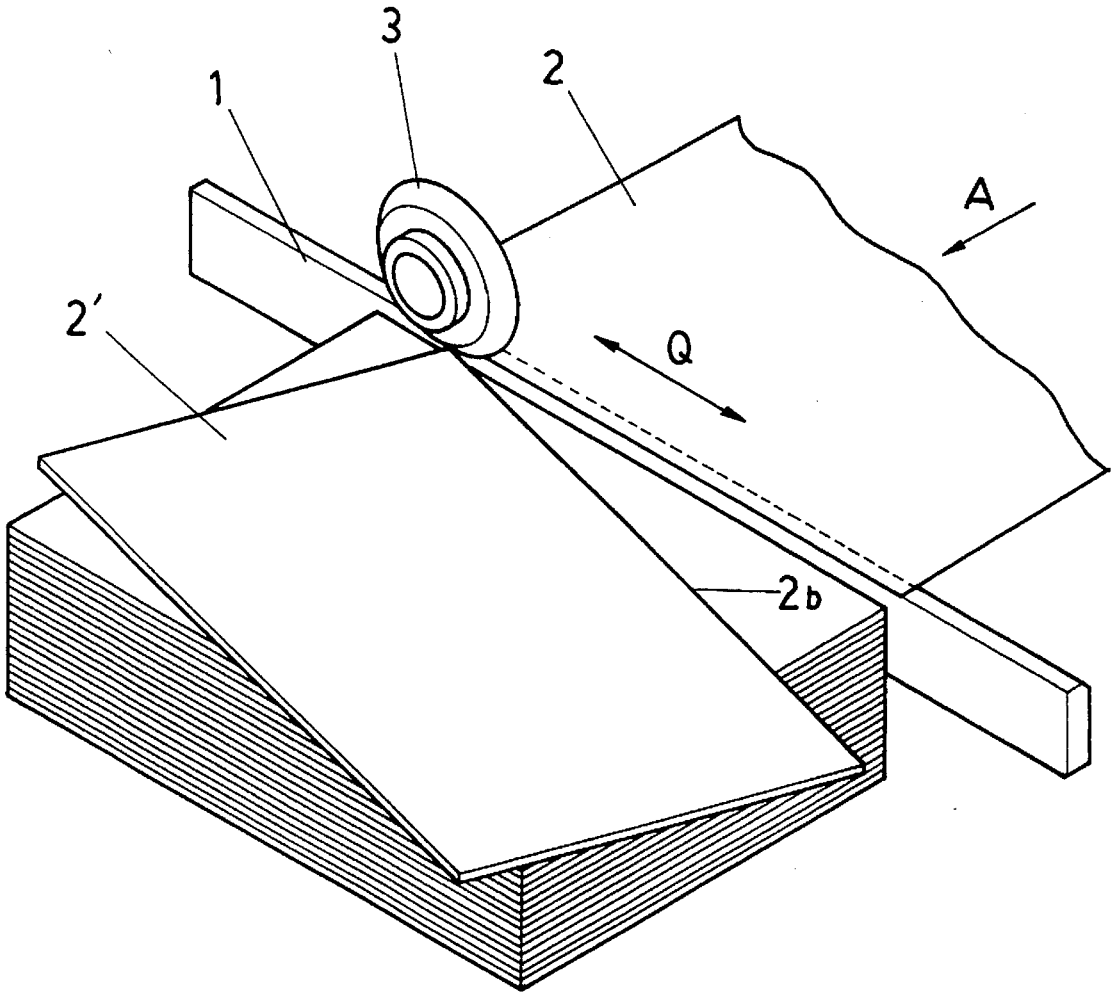
FIG 37 PRIOR ART
FIG. 37 is a perspective view of a conventional cutting device wherein a cut medium is positioned aslant relative to the edge of the fixed cutter.

Thirteenth Embodiment (FIG. 33)

A cutting device having an actuator capable of arbitrarily moving a medium displacement restricting member to the position where the surface of the medium is pressed on according to a thirteenth embodiment will be described with reference to FIG. 33. Elements corresponding to those in FIGS. 31 and 32 are denoted at the same numerals.

The cutting device of the thirteenth embodiment is different from that of the twelfth embodiment in FIG. 31 only in respect that the former comprises a solenoid 161 which is an actuator for arbitrarily moving the medium presser member 153 from a position where the medium presser member 153 is retracted from the surface 22*a* as illustrated by the chain line to a position where the medium presser member 153 presses on the surface 22*a* as illustrated by the solid line, and a solenoid driving selection switch 163 serving as a means for operating the solenoid 161 while interlocked with the cutting operation of the disc cutter 35 depending on the kind of medium.

The solenoid 161 is attached to the bracket 154 by way of a tension coil spring 64. When the solenoid 161 is OFF, the medium presser member 153 of the bracket 154 is at a position where the medium presser member 153 is retracted from the surface 22*a* as illustrated by a chain line in FIG. 33 due to the resiliency of the twist coil spring 160.

If the solenoid 161 is ON, the bracket 154 is swung clockwise in FIG. 33 so that the medium presser member 153 is moved to the position where it presses on the surface 22*a* as illustrated by the solid line in FIG. 33.

Accordingly, in the thirteenth embodiment, the medium presser member 153 can selectively press on the medium 22 depending on the kind of medium to be used.

Turning on the solenoid 161 interlocking with the cutting operation of the disc cutter 35 and turning off the solenoid 161 after the medium 22 is cut when the solenoid driving selection switch 163 is switched to turn on the solenoid 161, namely, ON and OFF control operations of the solenoid 161 can be performed, for example, as follows.

Two transmission type photosensors are disposed at positions corresponding to the inclined portions 154*e* and 154*f* at both sides of the cutting operation interlocking portion 154*c* of the bracket 154 for detecting the carriage 34 when the engaging outer peripheral portion 35*b* of the disc cutter 35 reaches the inclined portions 154*e* and 154f. ON and OFF control operations of the solenoid 161 can be performed by the control of a microcomputer in the manner that the solenoid 161 is turned on when one of the photosensors detects the carriage 34 for the first time during the movement of the carriage 34 together with the disc cutter 35 in the cutting direction from the home position and the solenoid 161 is turned off when the other photosensor detects the carriage 34 thereafter.

The first to thirteenth embodiments are explained in the case that the moving cutter is the rotating disc cutter but the present invention can be applied to a cutting device having a moving cutter which is not rotated but has a sharp edge capable of cutting into the medium along the fixed cutter with an inclined angle relative to the surface of the medium.

The cutting device according to the first to thirteenth embodiments has the following effects.

As mentioned above, according to the present invention, when the moving cutter cuts the medium, the medium is liable to get out of position in the direction perpendicular to the surface of the medium due to resistance caused by cutting the medium. However, the presser member presses on the medium at the position close to the cutting position when the medium is cut so that the presser member restrains the medium from getting out of position. Even a medium which has low rigidity and is liable to be deformed in the direction set forth above can be cut to be excellent in linearity at its cut edge.

Further, if the presser member moving means includes the engaging member, the presser member interlocking member and the biasing member, the pressing operation against the medium by the presser member can be interlocked with the cutting operation of the moving cutter. As a result, it is neither necessary to add a new control system, which moves the presser member timely relating to the cutting operation of the moving cutter to the control system of the apparatus, nor necessary to add an actuator, etc. for moving the presser member thereto, so that the control system is simplified and such an actuation is dispensed with, which results in the reduction of cost of the apparatus.

Still further, if the engaging member is movable to the position where the engaging member engages with the presser member interlocking member and to the position where the engaging member does not engage with the presser member interlocking member, the presser member can selectively perform the pressing operation depending on the kind of medium by way of a simple operation of merely changing the position of the engaging member. Accordingly, when the medium having high rigidity which is not necessary to be fixed by the presser member at the time of cutting is used, it is possible to freely select an operation corresponding to the kind of medium in such a manner that the presser member is not operated.

Further, if the presser member moving means is provided with the moving means for moving the presser member to the position where the medium is pressed and fixed at the position close to the cutting position and to the standby position and the control means for moving the presser member from the standby position to the position where the medium is pressed and fixed, the driving source of the moving means is driven while interlocked with the cutting operation by the moving cutter, thereby selectively performing the operation to move the presser member from the standby position to the position where the medium is pressed and fixed. Accordingly, when the medium is not necessary to be fixed by the presser member at the time of cutting, it is possible to perform an operation corresponding to the kind of medium in such a manner that the driving source is not operated.

Further, if the cutting device is provided with the separation guide member, it is possible to prevent the charged medium from being electrostatically attracted by the presser member so that the medium can be smoothly fed after printing is performed thereon.

Still furthermore, if the cutting device is provided with the medium displacement restricting member which is movable between the position where the medium is prevented from being displaced in the inner-surface direction of the medium and the standby position where the medium displacement restricting member retracts from the surface of the medium and the stack tray on which the cut medium is successively stacked and which moves away from the medium displacement restricting member in accordance with the number of cut mediums stacked thereon, the medium can be pressed by the medium displacement restricting member at the time of cutting. As a result, even if the cut medium is successively stacked on the stacker immediately after the cut medium is cut off from the medium such as long paper, etc. by the moving cutter along the edge of the fixed cutter, the moving cutter does not flip the cut medium, so that the cut medium can be stacked on the stacker in order.

Further, since the stack tray moves away from the medium displacement restricting member in accordance with the number of cut mediums stacked thereon while it is pressed by the medium displacement restricting member, the position of uppermost cut medium can be always at a given position even if the stack tray is not provided with an elevating means using a motor, etc., so as to simplify the apparatus by omitting such an elevating means therefrom.

Further, if the medium displacement restricting member is formed of a flexible belt, it can be moved to the position where it presses on the surface of the medium at the time of cutting the medium, so that the medium can be effectively cut without being displaced out of position.

Still further, if the cutting device is provided with the cutting operation interlocking member, the moving operation of the medium presser member between the position where it presses on the medium and the position where it is retracted from the surface of the medium can be interlocked with the cutting operation of the moving cutter. As a result, it is not necessary to add a control system for interlocking the movement of the medium presser member with the cutting operation of the moving cutter or an actuator for driving the medium presser member to the cutting device, which can simplify the structure of the cutting device and reduce the cost of the same.

What is claimed is:

1. A cutting device comprising:

at least a pair of a moving disc cutter and a fixed cutter which extends in a cutting direction, wherein the moving disc cutter moves along an edge of the fixed cutter extending in the cuffing direction when the moving disc cutter is brought into contact with the fixed cutter, thereby cutting a continuous medium which is interposed between the moving disc cutter and the fixed cutter;

a presser member for pressing and fixing the continuous medium to be cut at a portion close to a cutting position where the continuous medium is cut by the moving cutter and the fixed cutter;

presser member moving means for retracting the presser member to a standby position where the presser member is retracted from a surface of the continuous medium when the medium is fed to the cutting position and for moving the presser member in a direction perpendicular to the surface of the continuous medium to a position where the continuous medium is pressed and fixed when the continuous medium is fed to the cutting position to be cut there; and a separation guide member which advances between the presser member and the medium to separate the presser member from the medium so that the continuous medium does not contact the presser member when the moving disc cutter is not performing a cutting operation, and guides the continuous medium in a feeding direction when the continuous medium is fed to the cutting position to be cut by the moving disc cutter and the fixed cutter, and which retracts interlocking with a cutting operation of the moving disc cutter to release a separation of the presser member from the continuous medium when the continuous medium is fed to the cutting position to be cut.

2. A cutting device according to claim 1, wherein said presser member moving means includes an engaging member which is moved together with the moving disc cutter in the cutting direction when the moving disc cutter moves to cut the continuous medium, a presser member interlocking member having the presser integrally fixed thereto, the presser member interlocking member engaging the engaging member to move the presser member interlocking member during a cutting operation of the moving disc cutter when the continuous medium is cut, thereby moving the presser member to the position where the continuous medium is pressed and fixed, and biasing means for biasing the presser member interlocking member in a direction to bring the same in contact with the engaging member so as to position the presser member at the standby position when the moving disc cutter is stopped at a position where it does not cut the medium.

3. A cutting device according to claim 1, further including a pressure adjusting mechanism for adjusting pressure with which the presser member presses on the continuous medium to fix the continuous medium.

4. A cutting device according to claim 1, wherein the presser member is formed of a conductive elastic material at least at a portion where it contacts the continuous medium and the conductive elastic material comprises one of felt, urethane, rubber and sponge.

* * * * *

UNITED STATES PATENT AND TRADEMARK OFFICE

CERTIFICATE OF CORRECTION

PATENT NO.: 5,611,253
DATED : March 18, 1997
INVENTOR(S): Daisuke Saito and Hideaki Matsuda

It is certified that error appears in the above-identified patent and that said Letters Patent is hereby corrected as shown below:

In column 30, line 22, delete "cuffing" and insert therefor --cutting--.

Signed and Sealed this

First Day of July, 1997

Bruce Lehman

*Attest:*

BRUCE LEHMAN

*Attesting Officer*

*Commissioner of Patents and Trademarks*